US010159358B2

(12) United States Patent
Wells

(10) Patent No.: US 10,159,358 B2
(45) Date of Patent: Dec. 25, 2018

(54) PROTECTIVE NOOK FOR OPEN TRAY

(71) Applicant: Sheila M. Wells, Chicago, IL (US)

(72) Inventor: Sheila M. Wells, Chicago, IL (US)

( * ) Notice: Subject to any disclaimer, the term of this patent is extended or adjusted under 35 U.S.C. 154(b) by 238 days.

(21) Appl. No.: 15/154,429

(22) Filed: May 13, 2016

(65) Prior Publication Data

US 2016/0331152 A1 Nov. 17, 2016

Related U.S. Application Data

(60) Provisional application No. 62/161,646, filed on May 14, 2015.

(51) Int. Cl.
*A47D 15/00* (2006.01)
*A47D 1/00* (2006.01)

(52) U.S. Cl.
CPC ..... *A47D 15/00* (2013.01); *A47D 1/008* (2013.01)

(58) Field of Classification Search
CPC ..... A47D 15/00; A47D 1/008
USPC ..... 108/60–61
See application file for complete search history.

(56) References Cited

U.S. PATENT DOCUMENTS 256,272 A 4/1882 Bent
284,671 A 9/1883 Reed
402,788 A 5/1889 Vagandt
1,050,205 A 1/1913 Conley
1,377,860 A 5/1921 Thomas
2,526,576 A 7/1948 Nelson
2,468,856 A * 5/1949 Alexander ..... A47D 3/00 108/11
2,485,907 A 10/1949 Montoya
2,540,685 A 2/1951 Mayer
2,672,612 A 5/1952 Vale et al.
2,635,916 A * 4/1953 Hammond ..... B62B 9/14 280/47.4
2,807,312 A * 9/1957 Florian ..... A47D 1/008 108/27
2,935,209 A 2/1958 Fritz
2,938,574 A 5/1960 Brown
2,942,924 A * 6/1960 Stangert ..... A47B 21/03 108/27
3,110,934 A * 11/1963 Triplett ..... A47B 19/04 108/60

(Continued)

OTHER PUBLICATIONS

PCT International Search Report dated Aug. 11, 2016 for PCT/US2016/032424.

(Continued)

*Primary Examiner* — Hanh V Tran
(74) *Attorney, Agent, or Firm* — Greer, Burns & Crain, Ltd.

(57) ABSTRACT

A nook for protecting a surrounding environment from contamination and being removably attached to an outer circumferential periphery of an open chair tray for at least partially encompassing an upper surface of the tray. Included in the nook is an overhanging lip attached to the nook configured for overlapping a portion of the outer circumferential periphery of the tray. A flexible sheet has a substantially planar surface, and a pocket member is disposed on the flexible sheet and configured for placing an object within the pocket member. The nook is formed by bending the sheet into a generally "U"-shaped structure corresponding to the outer circumferential periphery of the tray.

17 Claims, 22 Drawing Sheets

(56) References Cited

U.S. PATENT DOCUMENTS 3,298,736 A 1/1967 Decker
3,629,960 A * 12/1971 Roush ..... A47B 41/06 108/27
4,165,123 A 8/1979 Huston
4,298,228 A 11/1981 Zampino
4,842,331 A 6/1989 Waples
4,848,834 A 7/1989 Linski
5,087,097 A * 2/1992 Hehn ..... A47D 1/008 297/149
5,294,172 A * 3/1994 Dubus ..... A47D 1/008 297/148
5,348,368 A 9/1994 Garcia et al.
D366,375 S * 1/1996 Cross ..... D6/715
5,625,910 A * 5/1997 Erickson ..... E03C 1/181 4/300.3
5,660,432 A 8/1997 Davis
5,809,900 A * 9/1998 Alexander ..... A47B 21/06 108/26
5,890,782 A * 4/1999 Alberts ..... A47B 17/00 108/27
5,908,002 A * 6/1999 Alexander ..... A47B 17/033 108/50.01
5,947,034 A 9/1999 Belka et al.
6,081,923 A 7/2000 Marks
6,213,191 B1 * 4/2001 Nitzsche ..... A47B 83/001 108/50.11
6,386,761 B1 * 5/2002 Bohnsack ..... A45C 3/00 383/24
6,551,166 B1 * 4/2003 Myers ..... A47C 21/048 446/227
6,647,899 B1 * 11/2003 Lysien ..... A47B 13/00 108/24
6,714,407 B2 * 3/2004 Zheng ..... A63B 9/00 135/143
6,796,606 B2 9/2004 Marshall
7,261,370 B1 * 8/2007 Whitesell, Jr. ..... A47D 1/004 297/153
7,284,790 B1 * 10/2007 Brewer ..... A47C 7/66 297/184.13
7,300,103 B1 11/2007 Grays
D585,671 S 2/2009 Munsterman
7,716,749 B2 5/2010 Perazzo
7,891,731 B2 2/2011 O'Toole
8,727,435 B2 5/2014 Centracco et al.
9,161,618 B2 10/2015 Wilson
9,706,856 B1 * 7/2017 Nevitt ..... A47D 15/00
2002/0040668 A1 * 4/2002 Pang Chan ..... A47B 17/003 108/157.1
2002/0189506 A1 * 12/2002 Hamilton ..... A47B 17/033 108/50.02
2005/0067549 A1 * 3/2005 Kintzele ..... A47D 15/00 248/690
2005/0126446 A1 * 6/2005 Nobles ..... A47C 7/72 108/27
2005/0183639 A1 * 8/2005 O'Leary ..... A47B 83/001 108/60
2005/0198733 A1 * 9/2005 Van Huystee ..... A47D 15/00 5/93.1
2008/0185881 A1 8/2008 Romaniuk et al.
2008/0230658 A1 * 9/2008 Waits ..... A47D 15/00 248/104
2011/0239908 A1 * 10/2011 Nakamura ..... A47B 17/00 108/50.11
2012/0007390 A1 1/2012 Hart
2012/0124751 A1 * 5/2012 Perry ..... A47D 9/00 5/663
2013/0154320 A1 * 6/2013 Byrd ..... A47D 15/00 297/219.12
2013/0161984 A1 6/2013 Yaghmai et al.
2013/0192000 A1 * 8/2013 Posner ..... A47D 15/00 5/658
2013/0200229 A1 * 8/2013 Corey ..... A47D 1/00 248/205.1
2014/0158024 A1 * 6/2014 Henriott ..... A47B 13/00 108/27
2014/0173800 A1 6/2014 Wulf et al.
2014/0208987 A1 * 7/2014 Varney ..... A47D 1/008 108/28
2015/0090162 A1 * 4/2015 Vlosich ..... A45C 11/00 108/18
2015/0108123 A1 * 4/2015 Linehan ..... A47D 3/00 220/17.1
2017/0043682 A1 * 2/2017 Yang ..... B60N 2/28
2017/0156515 A1 * 6/2017 Bracho ..... A47D 15/00

OTHER PUBLICATIONS

PCT International Searching Authority Written Opinion dated Aug. 11, 2016 for PCT/US2016/032424.

* cited by examiner

PROTECTIVE NOOK FOR OPEN TRAY

CROSS-REFERENCE

This application claims priority under 35 USC 119(e) from U.S. Provisional Application Ser. No. 62/161,646 filed May 14, 2015.

BACKGROUND

The present disclosure generally relates to enclosure or nook devices, and more particularly relates to a protective enclosure or nook used with an open tray for keeping materials or objects within the enclosure or nook.

Typically, infants and toddlers are not well coordinated to sit upright at a table or desk by themselves during feeding or play time. High chairs are commonly provided for infants and toddlers, and the chairs have a seat and a tray on which the toddler's food or toys are situated. As well known in the art, the contents of the tray easily become disorganized when the toddler throws and knocks the food, liquids and/or toys off the tray. Because conventional high chairs have an open tray without any nook, portions of the food, liquids and/or toys are displaced from the tray, and fall on the ground or floor, creating cleanup work or other chores for caregivers. Even for older children, who can feed themselves, there is usually a substantial mess created by the food, liquids and/or toys on the tray and floor, thereby necessitating a significant amount of cleanup work.

Thus, there is a need for developing an improved enclosure or nook for an open chair tray to keep the food, liquid and/or toys within the enclosure or nook of the tray, so that the mess can be readily cleaned and organized.

SUMMARY

The present disclosure is directed to a nook designed to protect an environment from contamination caused by materials, such as food, liquid and/or objects placed on an open chair tray. Specifically, the nook is removably attached to an outer circumferential periphery of the open chair tray for at least partially encompassing an upper surface of the tray. The nook has dimensions such that a user or child in the open chair is prevented from disposing the food, liquid, materials and/or objects over and around the tray when the nook is attached to the tray. In this configuration, the food, liquid and/or toys are better retained inside the nook. The nook and associated front pouch help prevent the food and liquids from falling or leaking through the space between the tray and the child. As a result, the need to clean up the floor and the child is significantly reduced.

Another important aspect of the present nook is a removably attachable pouch member having a plurality of optional gripping tabs or fingers. The pouch member may be used with or without the fingers. The pouch or pouch member is provided for catching or collecting materials, food, liquid and/or objects falling between the child and the tray and can be used to contain food or toys. Typically, the tray includes a removable upper tray member and a lower tray member, both members being matingly stackable on top of each other in a complementary relationship. The plurality of tabs, flaps or fingers with a gripping rubber like surface, such as a silicon structure, are inserted and sandwiched between the upper tray member and the lower tray member of the tray, such that the pouch member is frictionally secured in pressure-tight relation to the tray. The pouch member is usable for catching or containing food items and can be used as a transition guide when the child is learning to eat. The pouch snaps down in front along a first edge and then on another edge can un-snap and snap onto a bib or add more coverage between tray and toddler. The gripping tabs, flaps or fingers can be of any shape.

Also, the present nook is used as an educational or learning tool for the child when one or more stick-on activity items are applied to transparent or semi-transparent walls of the nook. As an example, stickers or the like activity items with an adhesive designed to be reusable are optionally applied on preferably transparent walls of the nook in aid of storytelling or for other educational purposes. Also, other toys using static cling vinyl or clinging vinyl can adhere to the outer surface of the walls as desired. When the static cling vinyl or clinging vinyl is applied to a clean, smooth, glossy surface of the preferably transparent walls, it readily adheres to the surface, and is helpful for conducting a customized educational session for teaching the child in the chair. Thus, this allows for the child to learn in a more sophisticated, detailed, and interesting way, and encourages the child to be more interactive with the caregiver during the feeding or play time.

In one embodiment, a nook is provided for protecting a surrounding environment from contamination and being removably attached to an outer circumferential periphery of an open chair tray for at least partially encompassing an upper surface of the tray. Included in the nook is a flap attached to the nook configured for overlapping a portion of the outer circumferential periphery of the tray. A flexible sheet has a substantially planar surface, and a pocket member is disposed on the flexible sheet and configured for placing an object within the pocket member. The nook is formed by bending the sheet into a generally "U"-shaped structure corresponding to the outer circumferential periphery of the tray.

In another embodiment, a nook is provided for protecting a surrounding environment from contamination and being removably attached to an outer circumferential periphery of an open chair tray for at least partially encompassing an upper surface of the tray. Included in the nook is a flap attached to the nook configured for overlapping a portion of the outer circumferential periphery of the tray. A flexible sheet has a substantially planar surface, and a removably attachable pouch member has a plurality of gripping finger flaps or fingers. The nook is formed by bending the sheet into a generally "U"-shaped structure corresponding to the outer circumferential periphery of the tray.

In yet another embodiment, a nook is provided for protecting a surrounding environment from contamination and being removably attached to an outer circumferential periphery of an open chair tray for at least partially encompassing an upper surface of the tray. Included in the nook is a flap attached to the nook configured for overlapping a portion of the outer circumferential periphery of the tray. A flexible sheet has a substantially planar surface, and the nook includes an upper flexible arch member and a lower flexible member for supporting the sheet. A removably attachable pouch member has a plurality of gripping fingers. The nook is formed by bending the sheet into a generally "U"-shaped structure corresponding to the outer circumferential periphery of the tray.

DETAILED DESCRIPTION

Figure 1:
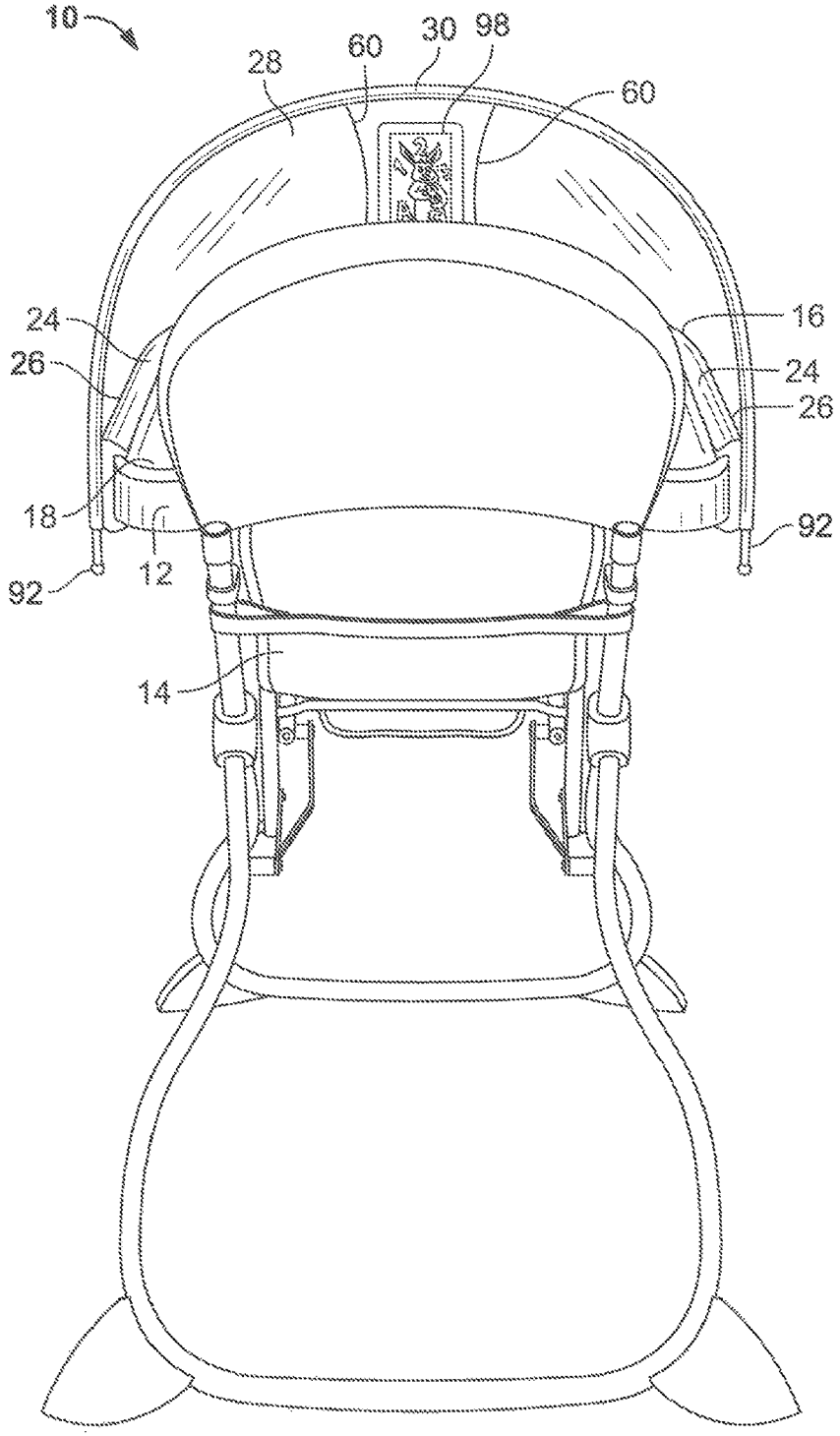
FIG. 1 is a perspective view of the present nook installed on a tray of an open chair, viewed from the rear, in accordance with an embodiment of the present disclosure.
Figure 2A:
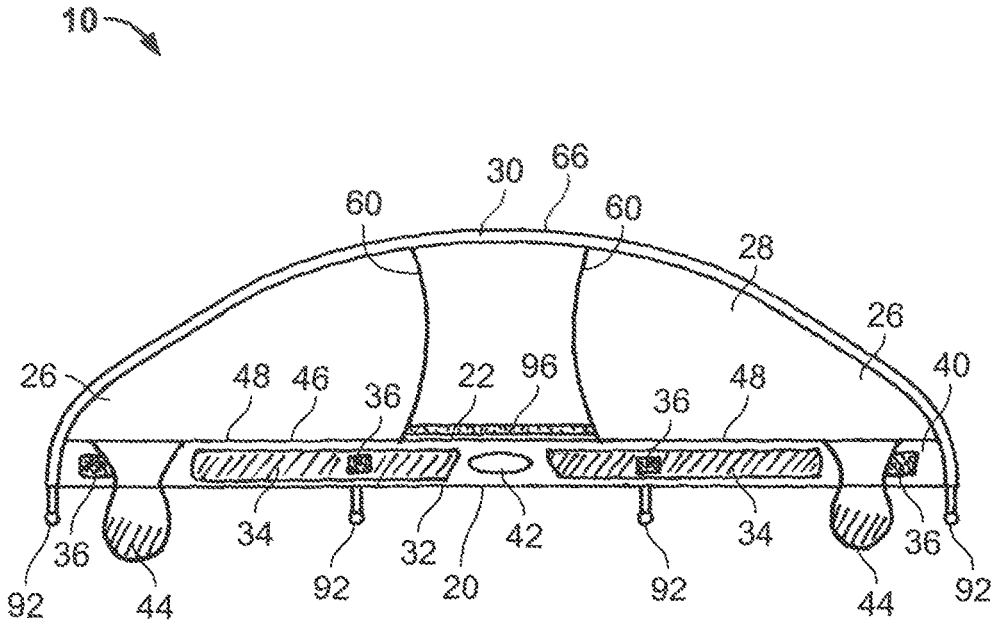
FIGS. 2A-2D illustrate a front view of the present nook of FIG. 1, featuring a set of tabs or fingers and rubber or silicone gripping members.
Figure 2B:
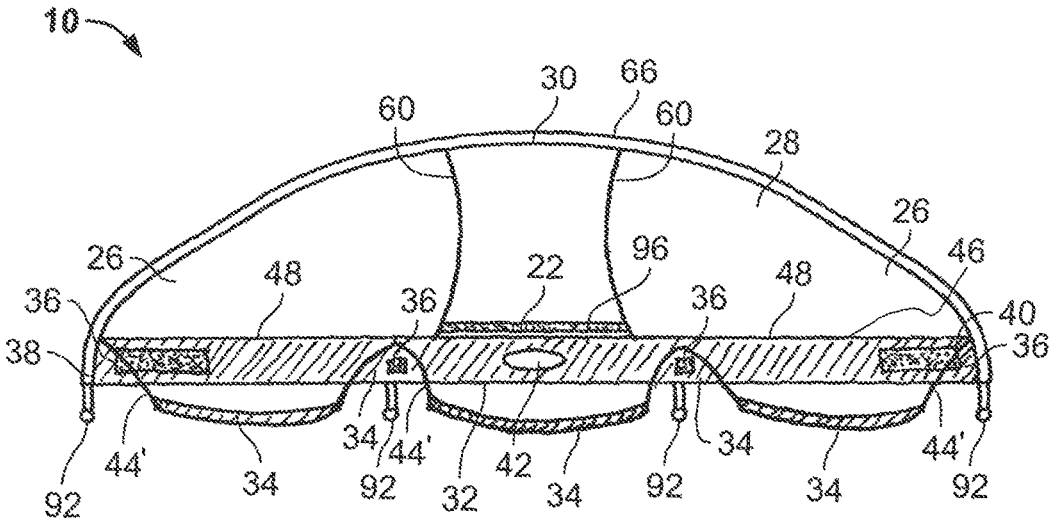

Referring now to FIGS. 1, 2A and 2B, an exemplary enclosure or nook of the present disclosure is generally designated 10 and is designed to protect a surrounding environment from contamination caused by food, liquid, materials and/or objects placed on a tray 12 of an open chair 14. An important aspect of the present nook 10 is that it is removably attached to an outer circumferential periphery 16 of the open chair tray 12 for at least partially encompassing an upper surface 18 of the tray. As discussed above, the present nook 10 has dimensions such that a user or child in the open chair tray 12 is prevented from disposing the food, liquid, toys, materials and/or objects over and around the tray 12.

In one embodiment, a front flap or overhanging lip 20 is attached to a middle region 22 of the present nook 10 for overlapping a portion of the outer circumferential periphery 16 of the tray 12. Similarly, at least one side flap or overhanging lip 24 is attached to a respective side region 26 of the present nook 10 for overlapping the portion of the periphery 16, such that the flaps or lips 20, 24 (collectively, an overhanging lip) hold the present nook 10 in an upright position relative to the tray 12. It is contemplated that the flaps or lips 20, 24 (the overhanging lip) are fixedly attached to the present nook 10 by suitable attachment methods known in the art, such as hot melting, stitching, adhesives, or the like. In a preferred embodiment, the flaps or lips 20, 24 are integrally formed as a continuous single unit (the overhanging lip) extending from a bottom peripheral portion of the present nook 10, seamlessly enclosing protrusions and curvatures of the tray 12. It is contemplated that a pocket member or open-ended pocket sleeve 60 is provided in the middle region 22 of the present nook 10 for storing an object or material 98, such as electronic devices.

Referring now to FIGS. 1, 2A-2C, and 3A-3C, it is preferred that the present nook 10 has a flexible, substantially semicircular or curve-edged sheet 28 having a substantially planar surface. Specifically, the present nook 10 has an upper flexible arch member 30, and a lower flexible member 32 for supporting the sheet 28 of the present nook 10. It is contemplated that the lower flexible member 32 has a gripping surface or strip 34 along a length of the lower flexible member for providing a friction force between the outer circumferential periphery 16 of the tray 12 and the present nook 10. An additional material, such as silicon, rubber, or the like, can be applied or layered on an inner surface of the lower flexible member 32 to provide an enhanced gripping force. The inner surface of the lower flexible member 32 can also be textured. It is also contemplated that an upper portion of the lower flexible member 32 can be curved for an additional coverage, and not limited to a straight line. Locations of the gripping surface or strip 34 may vary depending on different applications. As an example only, an inner or outer surface of the lower flexible member 32 has the gripping surface or strip 34, and the gripping surface may be enhanced with additional adhesive, hook and loop fasteners, dual locks and the like.

Figure 3A:
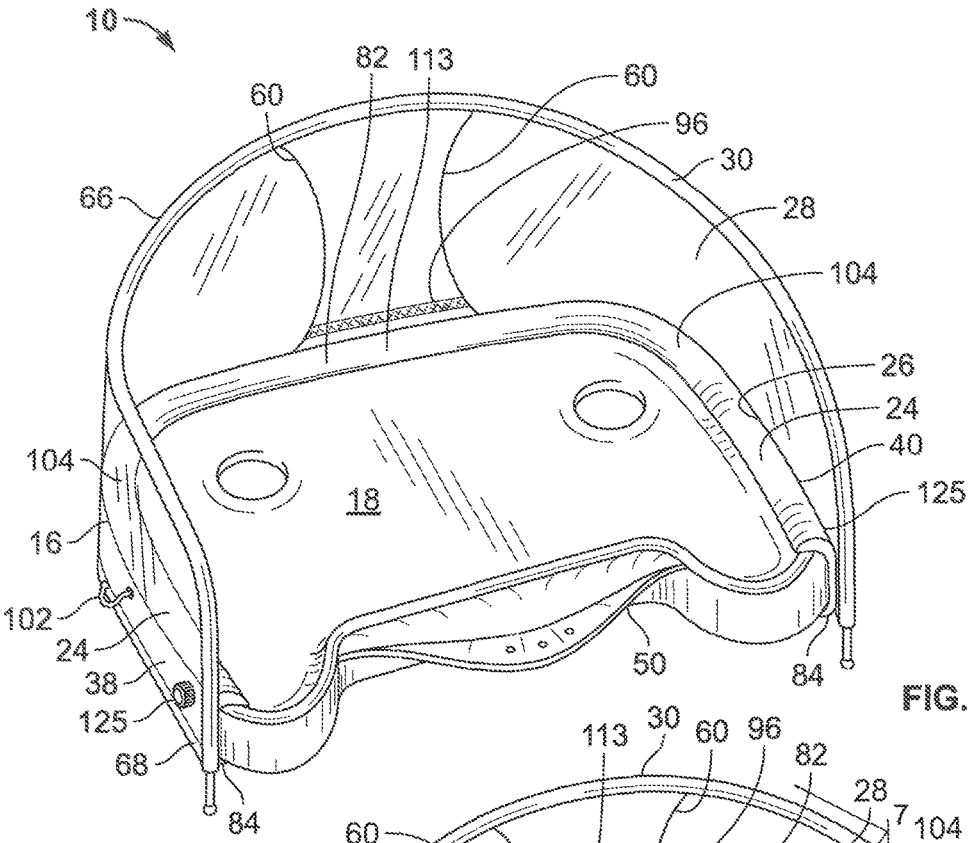
FIGS. 3A-3C illustrate a perspective view of the present nook of FIG. 2A, featuring a side auxiliary pouch member.

Although the semicircular shape is shown for the sheet 28, other suitable shapes, such as rectangular, square, oval, circular with curving configurations are contemplated to suit different applications. As shown in FIG. 3A, the present nook 10 is formed by bending the sheet 28 into a generally "U"-shaped structure corresponding to the outer circumferential periphery 16 of the tray 12. It is also contemplated that a children themed border or creative border 94 is disposed near a bottom peripheral edge of the present nook 10 to provide an aesthetic appearance and to hide the inner liner construction of the circumferential periphery 16 of the tray 12.

To achieve the attachment of the present nook 10 to the tray 12, one or more separate hook and loop or dual lock fastener 36 (e.g., in a male to female complementary relationship) is provided in a first or left attachment region 38 and a second or right attachment region 40. Similarly, the corresponding outer circumferential periphery 16 of the tray 12 has respective complementary hook and loop or dual lock mating surfaces or fastener. Exemplary dual lock male to female attachment methods or options are described in greater detail below in paragraphs related to FIGS. 17A-17C and FIG. 5. In a preferred embodiment, a throughbore 42 is disposed in the middle region 22 of the lower flexible member 32 for receiving a corresponding access to the tray 12 (e.g., via a tray button) and for readily removing the nook 10 and the tray. It is contemplated that the hook and loop fastener 36 can be replaced or used with other suitable fasteners, such as dual lock snaps. In another embodiment, an opening 110 is provided in the tray 12 for a secure attachment and is used to add extra security when a heavier object is placed in a pouch member 50, for example, and the accommodating material 117 (e.g., a fabric section) is used.

Figure 2C:
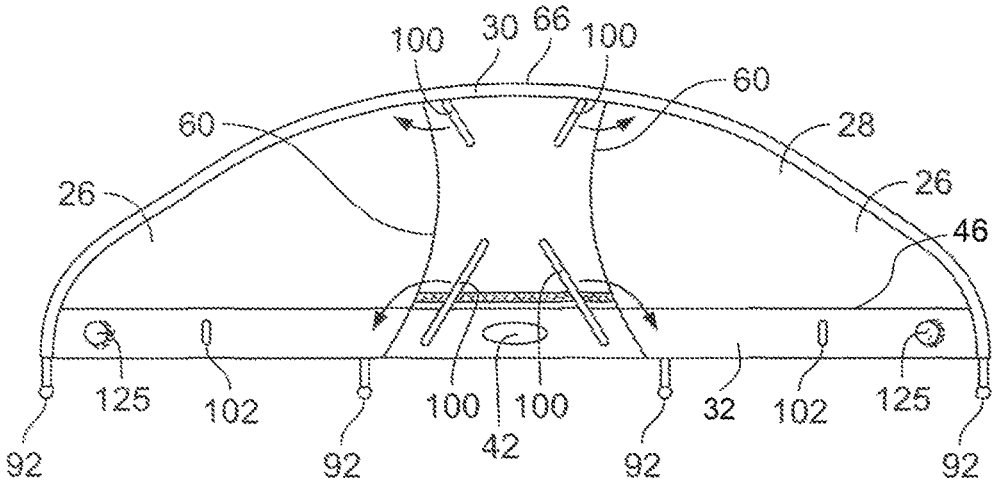

As shown in FIG. 2C, it is contemplated that a securing member 100, such as a swivel arm, a hook, a clip, or the like, is disposed near an outer peripheral edge, such a front middle region of the pocket member 60 for securing an electronic device or an object associated with the present nook 10. For example, a clip-like attachment member with gripping properties can be used to securely hold the device or object in the present nook 10 during use. It is also contemplated that a hook 102 is attached at the lower flexible member 32 of the present nook 10 for releasable attaching various objects.

Figure 4A:
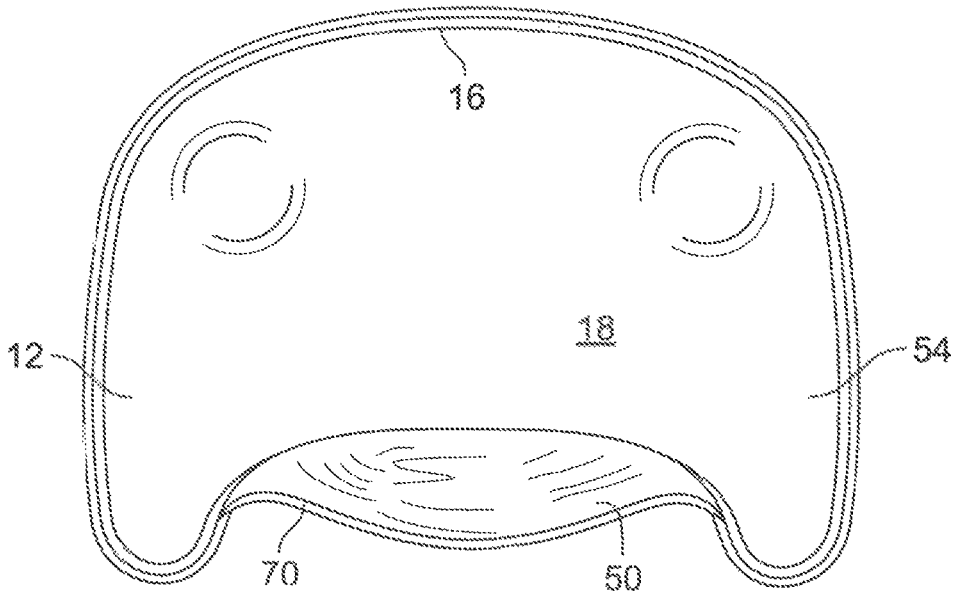
FIGS. 4A and 4B illustrate a plan view of the pouch member of FIG. 3A shown mounted on a tray.
Figure 4B:
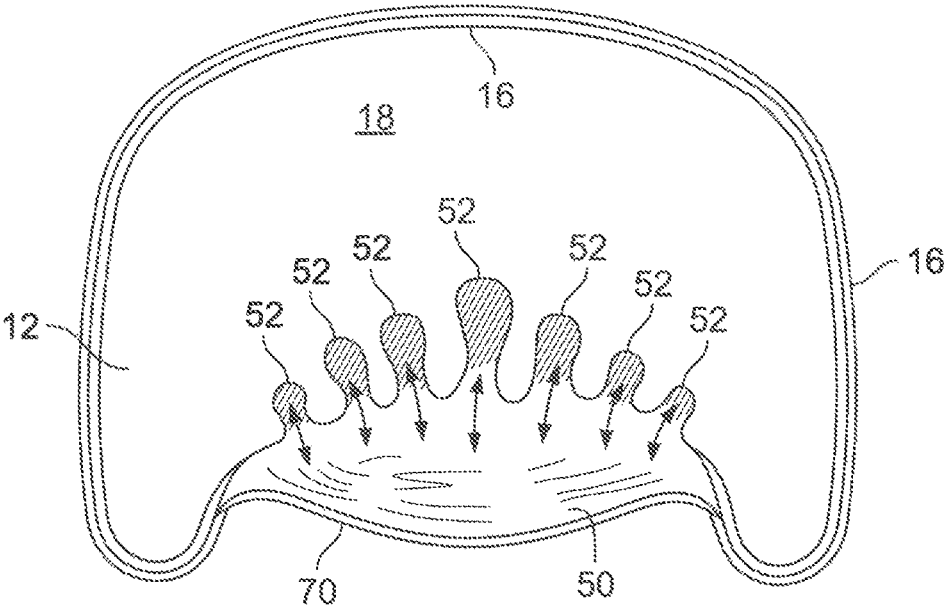

Another important aspect of the present nook 10 is that the lower flexible member 32 has an optional set of first flexible gripping tabs, flaps or fingers 44 extending from an upper edge 46 of the lower flexible member in the corresponding left and right attachment regions 38, 40. As shown in FIG. 2B, the tabs, flaps or fingers 44' can have a wider width for providing the friction force between the present nook 10 and the tray 12 when assembled. This configuration of the tabs, flaps or fingers 44' of the present nook 10 provides a stronger and tighter attachment to the tray 12. Other suitable locations of the tabs 44 are contemplated to suit the application. It is contemplated that the term "flexible" used herein refers to any suitable soft, flexible material, such as a vinyl or plastic. Detailed descriptions of an exemplary use of the tabs 44 are provided below in paragraphs relating to FIGS. 4A, 4B, and 5. A shape of the tabs, flaps or fingers 44, 44' is variable to suit different applications.

In addition to the flaps 20, 24, a flexible inner liner member 48, such as a foam, rubber or silicone or the like conduit, is preferably fixedly attached near the upper edge 46 of the lower flexible member 32 of the present nook 10 for overlapping or underlapping the portions of the periphery 16 of the tray 12 and thus securing the present nook in the upright position relative to the tray. In this configuration, the liquids or other similar materials are prevented from leaking or overflowing from the tray 12, thereby providing a tight seal for void areas around the tray. It is contemplated that the flaps inner liner and other components of the nook 10 can be coated or added with flexible materials, such as foam, silicone, rubber, or the like, to provide secure attachment to the tray 12 and to fill or seal negative space or gaps between the tray and the nook 10. Further, the density of the inner liner or flaps 20, 24 can be variable or tapered, and have a different thickness along the length of the flaps to provide different gripping and sealing force. It is also contemplated that the inner liner member 48 is sectional, segmented, or continuous along the length of the periphery 16 of the tray 12 depending on different applications. Advantageously, the present nook 10 can be customized to a particular shape or design of the tray 12.

Figure 3B:
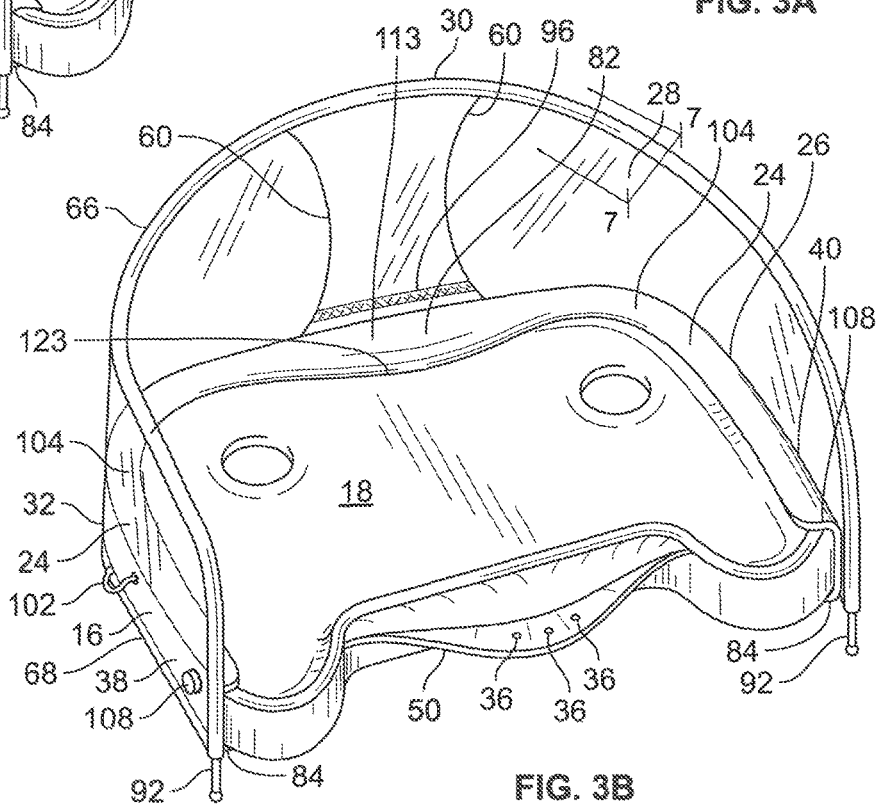
Figure 3C:
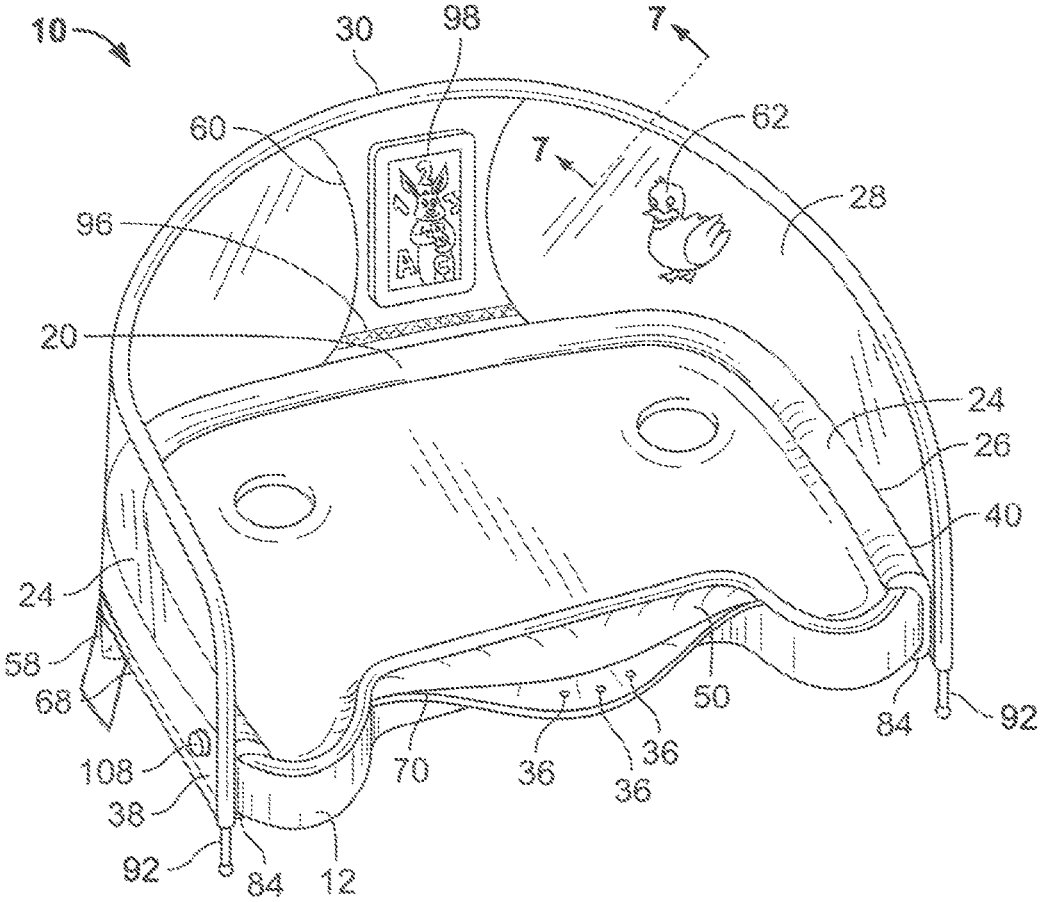

FIG. 3B illustrates another embodiment of the inner liner member 48 designated 123. It is contemplated that the inner liner member 123 has a protruding middle region under the pocket member 60, and continuously encloses the periphery 16 of the tray 12 along the length of the inner liner member. Advantageously, the inner liner member 123 has a generally "C"-shaped configuration to fit the periphery 16 of the tray 12 and encloses a front profile of the periphery of the tray, thereby providing additional support coverage and tight sealing between the tray and the nook 10.

Referring now to FIGS. 1, 3A-3C, 4A, 4B, and 5, it is preferred that the present nook 10 includes a removably attachable pouch member 50 having a plurality of second tabs or gripping fingers or flap 52 for catching or collecting the materials, such as food, liquids or objects falling from the tray 12. It is contemplated that the tray 12 includes an upper tray member 54 and a lower tray member 56, wherein both tray members 54, 56 are matingly stackable on top of each other in a complementary relationship.

More specifically, the second tabs 52 are inserted and sandwiched between the upper tray member 54 and the lower tray member of the tray 56, such that the pouch member 50 is frictionally secured in a sandwiched, pressure-tight relation to the tray 12 when the tray members 54, 56 are assembled. A front area of the pouch member 50 bends over and snaps to itself. When unsnapped, the pouch member 50 creates more coverage and can snap to a child's bib, forming a guide for the food to a child's mouth as the pouch member can be used to contain food such as dry cereal. The pouch member 50 can be used in other areas around the periphery 16 of the tray 12, for storing play activity items, as desired. It is contemplated that the fastener or snaps 36 of the pouch member 50 can become a closing flap when closed forward by snapping onto or toward an inner portion of the pouch member adjacent to the tray 12 rivets or silicone are also contemplated.

Similarly, the first tabs 44 extending the lower flexible member 32 are also inserted and sandwiched between the upper and lower tray members 54, 56, such that the present nook 10 is securely attached to the tray 12. As another example shown in FIG. 3B, an additional transparent or semitransparent auxiliary pouch member 58 can be attached to the tray 12 for storing cell phones or baby items using the tabs 44, 52, the hook and loop fasteners 36, or other suitable attachment methods known in the art. The auxiliary pouch member 58 and the pocket member 60 may include through-bores 42 to enhance sound quality generated from electronic device disposed in the pouch members.

Returning again to FIGS. 1 and 3A-3C, it is preferred that the present nook 10 has the pocket member 60 (FIG. 1) disposed on the flexible sheet 28 and configured for storing or placing an object or material 98, such as electronic devices including, but not limited to, a cellular phone, a palm top, a tablet pc, and the like, as desired for a learning or entertaining feature. For example, the electronic devices 98 can be inserted and securely held in the pocket member 60 during use. As with the pocket member 60, it is contemplated that the pouch members 58 can also be used to store and protect the electronic devices, objects or other materials 98 using hooks or the like attachment devices to the upper arch member 30. For example, a telecommunication device is inserted into the pouch or sleeve members 60, 58 for providing a social broadcast environment related to a learning, virtual soothing, or interactive experience.

Figure 18A:
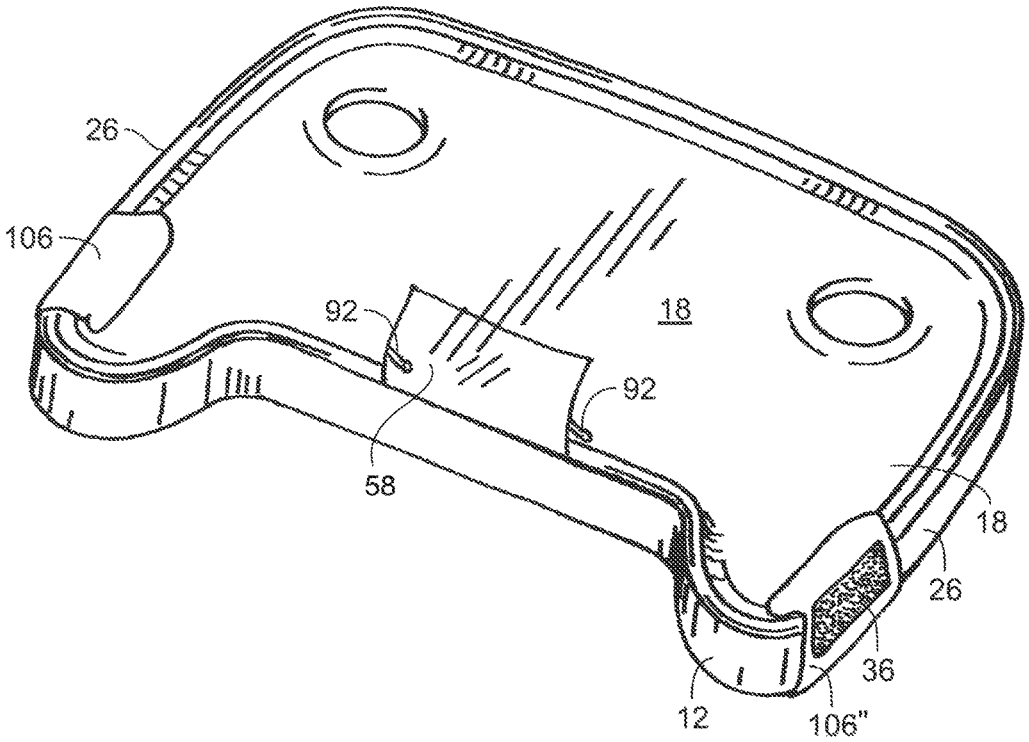
FIGS. 18A-18C illustrate an attachment member configured for attaching the present nook to the tray.
Figure 18B:
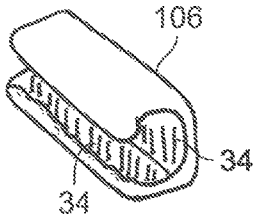
Figure 18C:
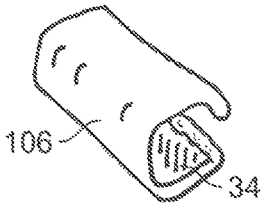

FIG. 18A shows an example of the auxiliary pouch member 58 positioned in front of a user as does the auxiliary pouch member 58 for an entertaining experience, when a device is placed in the transparent pouch opening and can be flipped up and over using the bendable rubber hook 92 for establishing an upper stabilization mounting support or to hook to the periphery 16 of tray 12. The auxiliary pouch member 58 can also hang slightly tilted upward on its own. This also creates a protective covering for a device, and the auxiliary pouch member 58 can be variably positioned around the tray 12.

Figure 5:
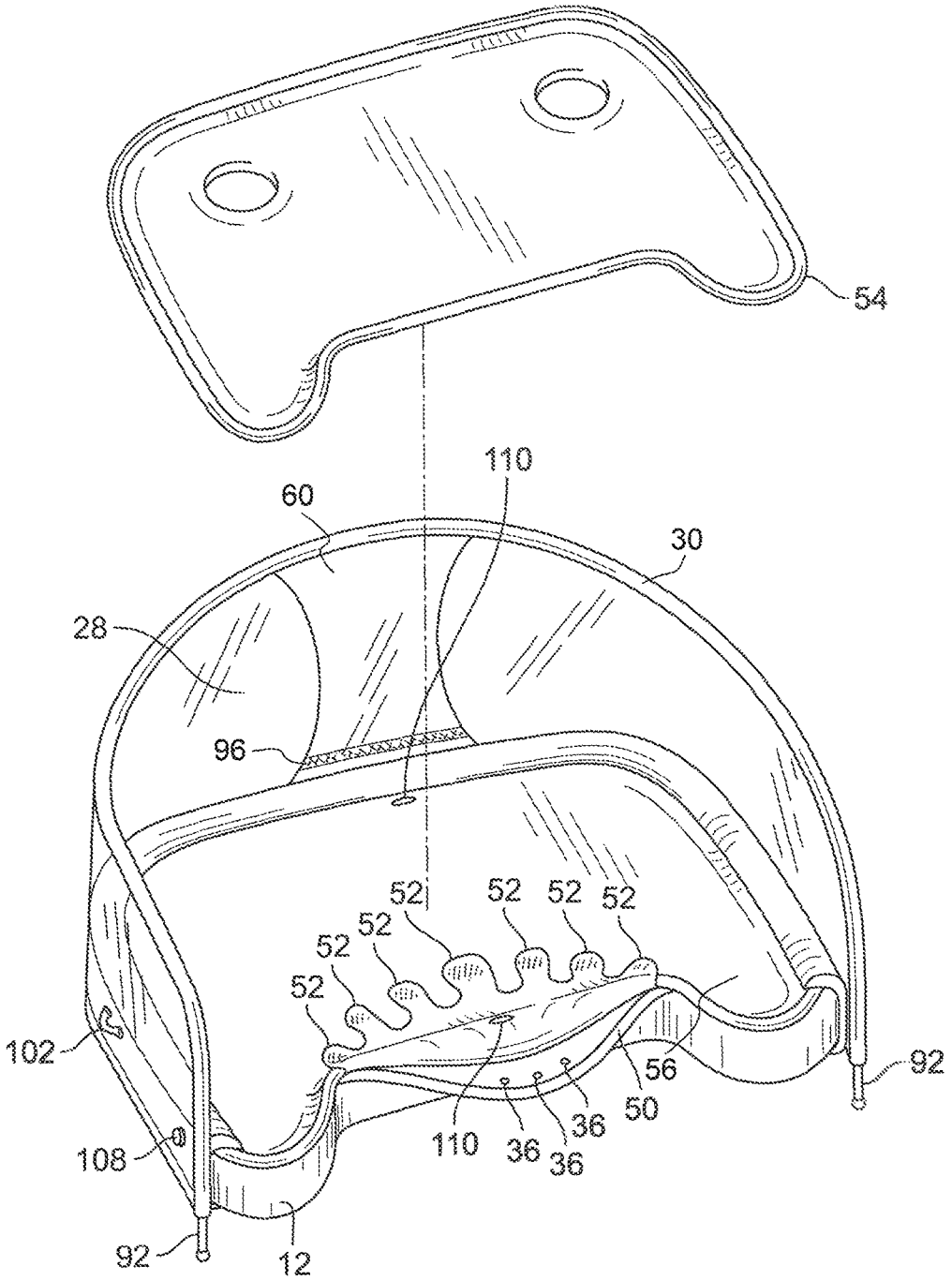
FIG. 5 is a perspective view of the present nook and pouch member of FIG. 3A without an upper tray member of the tray.

As shown in FIG. 5, the pouch member 50 can be variably positioned around the outer peripheral edge of the tray 12 to catch any loose items on the tray during use. It is also contemplated that the pocket member 60 is double-layered (e.g., having inner and outer layers) and includes a fastening member 96, such as a hook and loop fastener, snaps, male and female lock in a complementary relationship, for releasably attaching respective ends of the layers of the pocket member for making the sleeve 60 a larger opening for larger electronic device or object. It is contemplated that components of the nook 10 are preferably made of a clear or transparent material, such as a vinyl or polymeric sheet with sufficient transparency.

As discussed above, another important aspect of the present nook 10 is that the nook can be used as an educational or learning tool for the child when one or more stick-on activity items 62 (FIG. 3B) are applied to an at least transparent surface of the sheet 28. As an example, the stick-on activity items 62 with an adhesive or cling on composition designed to be reusable are applied on the preferably transparent surface of the nook 10. Also, other toys (not shown) using static cling vinyl can adhere to an outer or inner surface of the nook 10 as desired.

Figure 6:
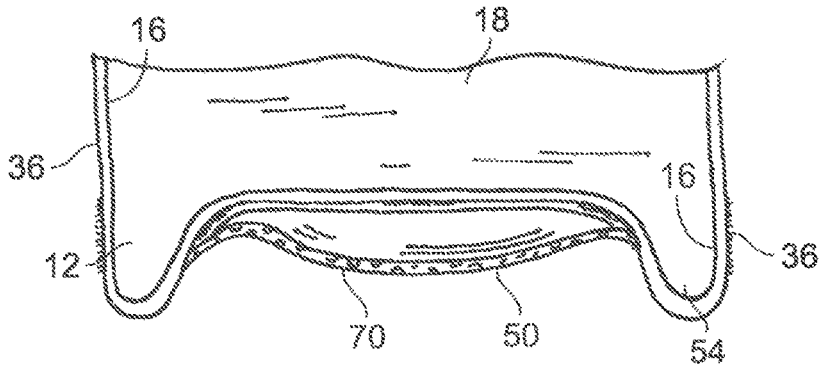
FIG. 6 is a plan view of the pouch member of FIG. 3A having attachment tray members.

Referring now to FIGS. 5 and 6, it is contemplated that the pouch member 50 has one or more hook and loop fasteners 36 instead of or in addition to the second tabs 52 for achieving a secure attachment to the tray 12. As discussed above, the corresponding outer circumferential periphery 16 of the tray 12 has respective complementary hook and loop or dual lock mating surfaces or fastener 36. In lieu of the tabs 52, other attachment methods, such as a hook and loop fastener or an attachable coated wire, can be used to attach the pouch member 50 to the tray 12.

Figure 7:
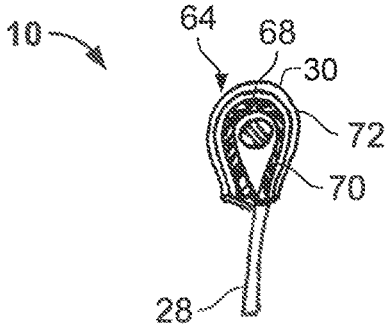
FIG. 7 is a cross-section of a rolled hem extending along a top and side edges of the present nook, taken along the line 7-7 of FIG. 3B and in the direction generally indicated.
Figure 8:
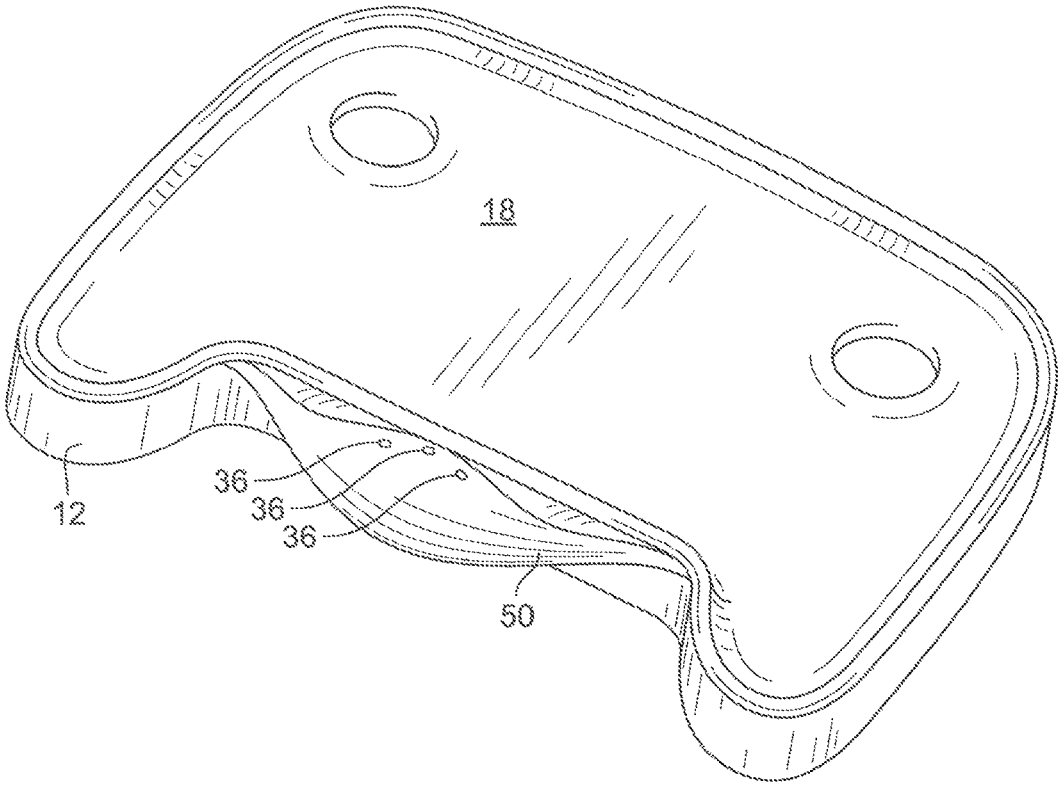
FIG. 8 is a perspective view of the pouch member of FIG. 3A when a flap is unsnapped.
Figure 9:
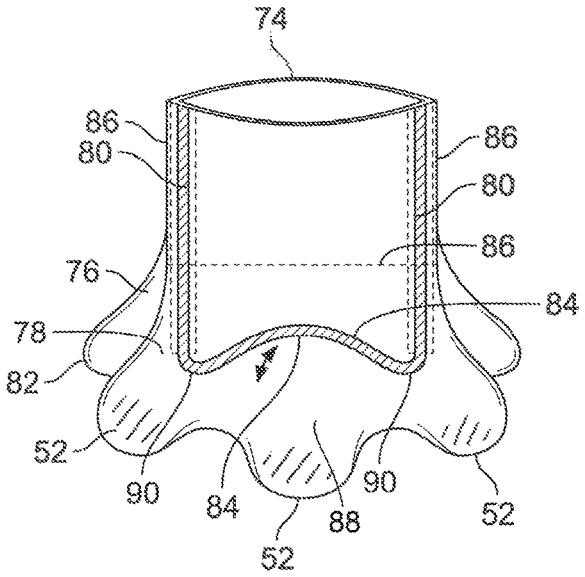
FIG. 9 is a front view of an upward or vertically oriented pouch.
Figure 10:
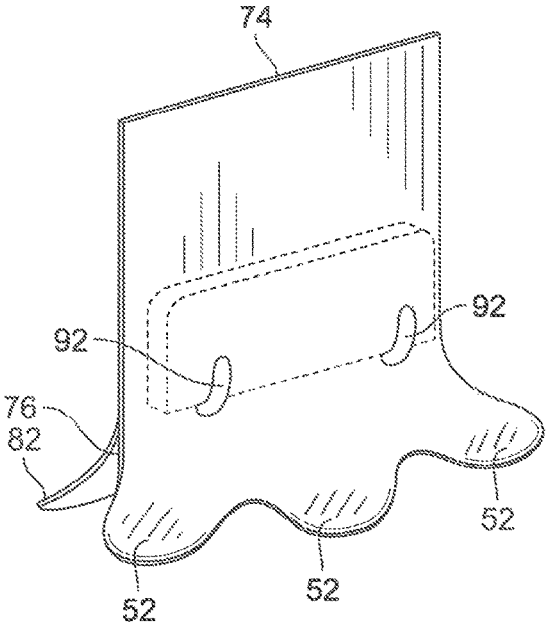
FIG. 10 is a front view of a front panel of the upward pouch of FIG. 9.
Figure 11:
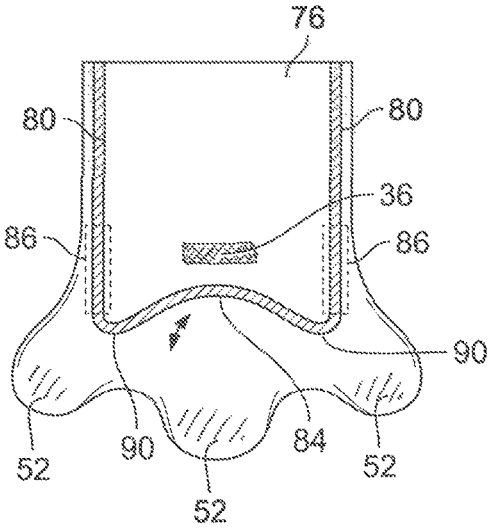
FIG. 11 is a front view of a back panel of the upward pouch of FIG. 9.

Referring now to FIGS. 5, 7 and 8, in a preferred embodiment, the upper arch member 30 of the present nook 10 has a rolled hem or rounded channel 64 extending along the upper edge 66 of the sheet 28. Specifically, the rolled hem or rounded channel 64 is formed, in part, using a folded or rolled-over vinyl bead 72 of transparent vinyl material. It is contemplated that an optional flexible, reinforcing wire or boning 70 is inserted in the folded or rolled-over bead 72, and extends along the length of the hem 64 for resiliently maintaining an overall shape or curvature of the present nook 10. The boning 70 is also provided to flexibly and selectively change or modify the shape of the pouch member 60. Also, an optional cloth-like covering 68 wraps around the wire or boning along the length of the hem 64 to overlay the wire or boning for concealment.

In this configuration, a bending resistance and an aesthetic appearance of the present nook 10 is enhanced as to the features which would otherwise have been missing if a raw edge is utilized. The upper arch member 30 can also be molded into the nook 10 with similar properties of the inner casing materials, such as a steel or plastic boning FIG. 8 is a perspective view of the pouch member of FIG. 3A when a flap is unsnapped. It is contemplated that a casing design and structure of the arch member 30 and the arch inner casing material includes a wire or the like such that the arch member resiliently returns to its original position and shape during use. The boning 70 may be made of steel, plastic boning other flexible material known in the art.

Referring now to FIGS. 9-13, and 18A an upwardly projecting, vertically-oriented transparent pouch 74 is configured for storing an object or material as similarly shown for the pocket member 60. A density of the pouch 74 may vary for allowing the pocket member to be vertically stronger at its highest point. Also, an additional upright strength can be added by incorporating a casing or a denser molded lip edge to the curved opening areas of the pouch 74. An overall shape of the pouch 74 is variable to suit different applications. It has a first gripping clamp-like member 84, which is bendable and placed on a back member 76 of the upward pouch 74 to be placed under and in front of the tray 12. There is a second gripping clamp-like member 88 at a lower front region of a front member 78 of the upward pouch 74. There is a stabilizing front flap 82 that lays in front of the tray 12 configured for providing a continuous inner support. A fastener 36 can optionally also be added to a front flap inner surface 82 and applied to tray 12 for supplemental fastening where needed. A heat melt or stitch method 86 can optionally be used when attaching the front 78 to back 76.

Figure 12:
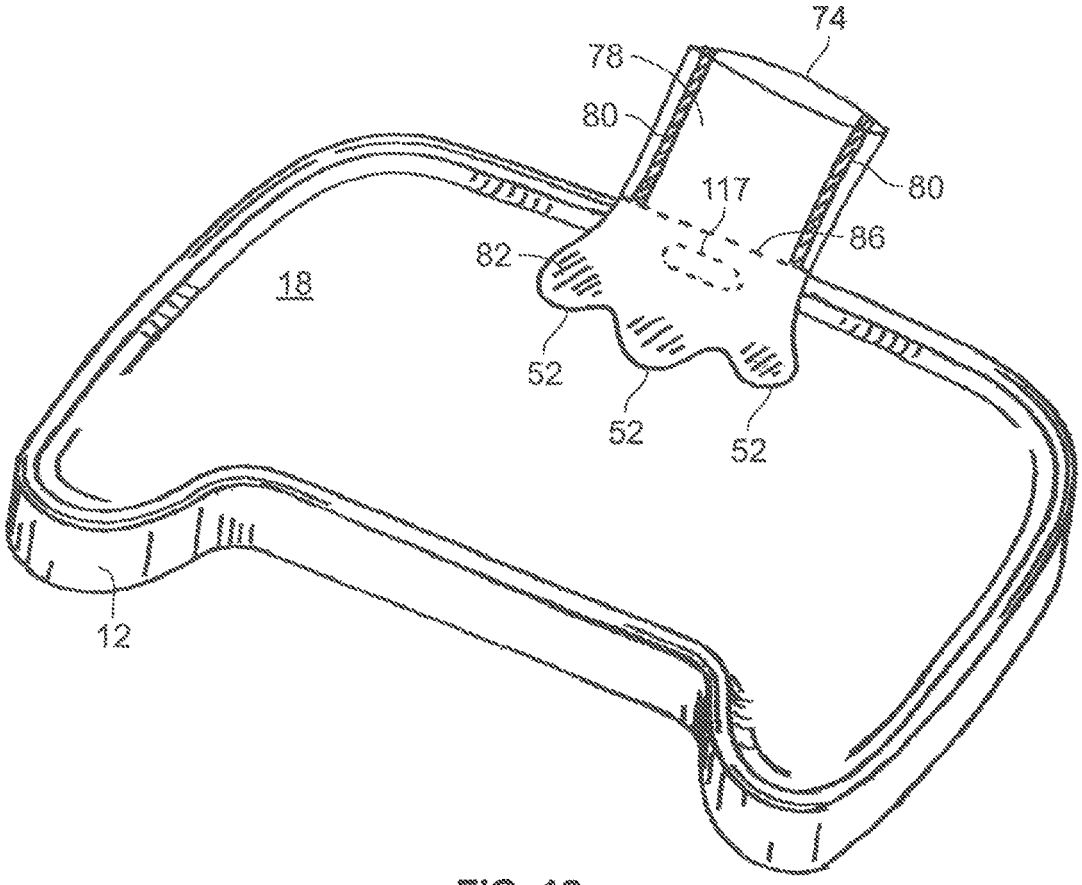
FIG. 12 is a perspective view of the upward pouch of FIG. 9 without the upper tray member.
Figure 13A:
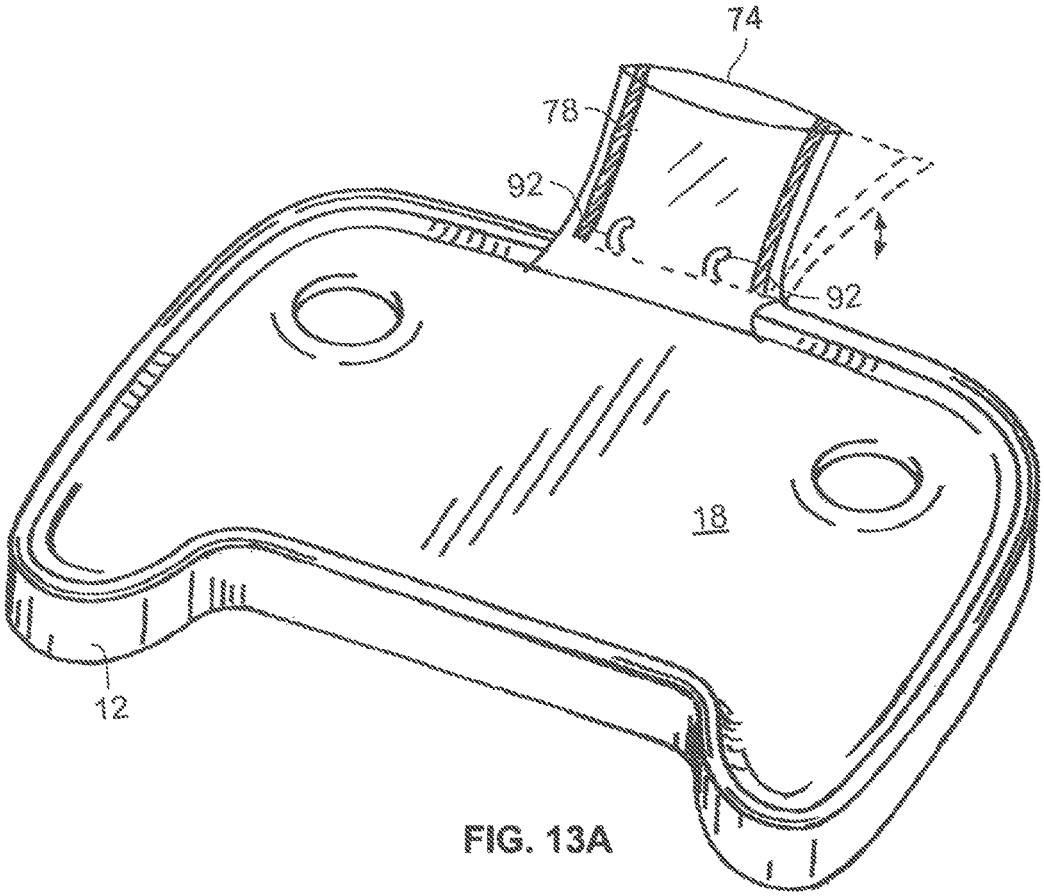
FIG. 13A is a perspective view of the upward pouch of FIG. 9 with the upper tray member.
Figure 13B:
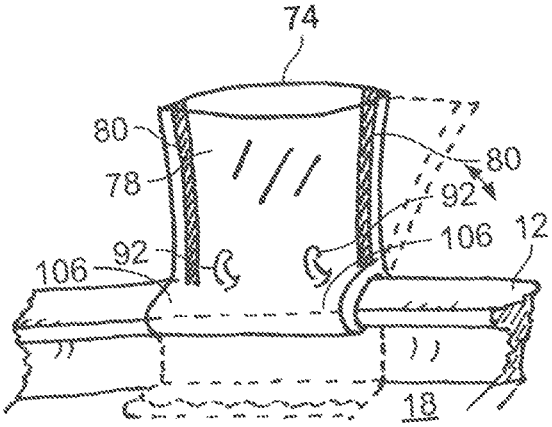
FIG. 13B is a perspective view of the upward pouch of FIG. 9 with an attachment.

The finger tabs 52 are used as extra holding strength for heavier items stored in the pouch 74 so that the pouch could stand on its own without the tab fingers and with clamping only. Exemplary clamping includes a manual clamping and a spring-biased clamping, but other clamping methods are also contemplated to suit different applications. Various combinations of different fasteners or clamping methods are contemplated to suit the application. For example, a dual lock or a hook and loop fastener can be used together. The tab fingers 52 of pouch 74 are sandwiched in between tray member 54 and 56 as mentioned in above art. There is a bending tilting member 80 and bendable rubber-coated hook members 92 allowing a device to be mounted without protective upward pouch covering. On the front of panel 76, an encasing member 90 is provided to encase the members 80. It is also contemplated that the upward pouch 74 acts as an upward support for an optional mounting placement of the present device when the hook members 92 are utilized. FIG. 12 shows the pouch 74 without the upper tray member 54, and FIG. 13 shows the pouch 74 with the tray member 54 sandwiching the fingers 52 with the tray below.

Figure 14:
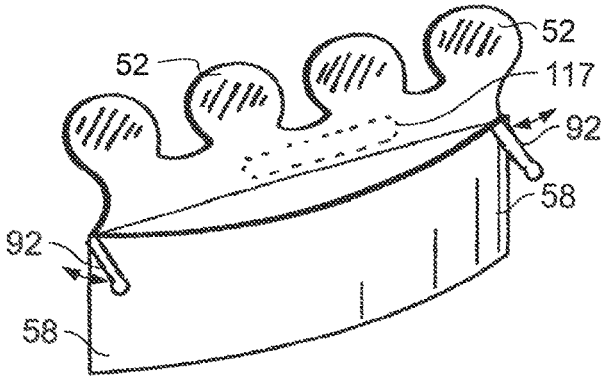
FIGS. 14 and 15 illustrate an exemplary pouches used with the present nook.
Figure 15:
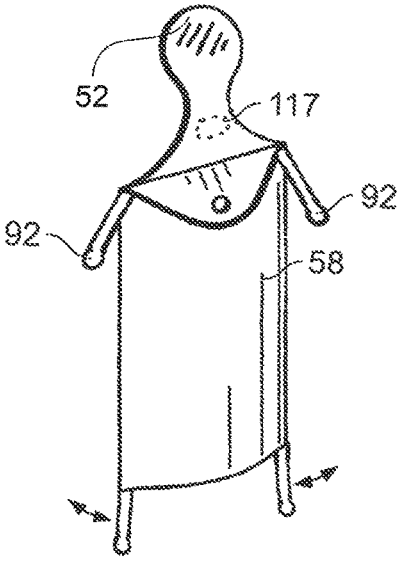

Referring now to FIGS. 14, 15, and 16A-16C, various types or embodiments of auxiliary pouch member 58', 58" and gripping strips 34', 34", 34'" are shown. FIG. 14 shows the auxiliary pouch member 58' having a plurality of fingers 52. FIG. 15 shows the auxiliary pouch member 58" having a single finger 52. An important aspect of the auxiliary pouch member 58', 58" is that a partial accommodating material region 117 is included for providing recoverable stretch properties. For example, the accommodating material region 117 is made of a fabric woven from warp and/or weft yarns or elastic materials or a stretching fabric. Similarly, the accommodating material region 117 can be incorporated in the pouch member 50.

Figure 16A:
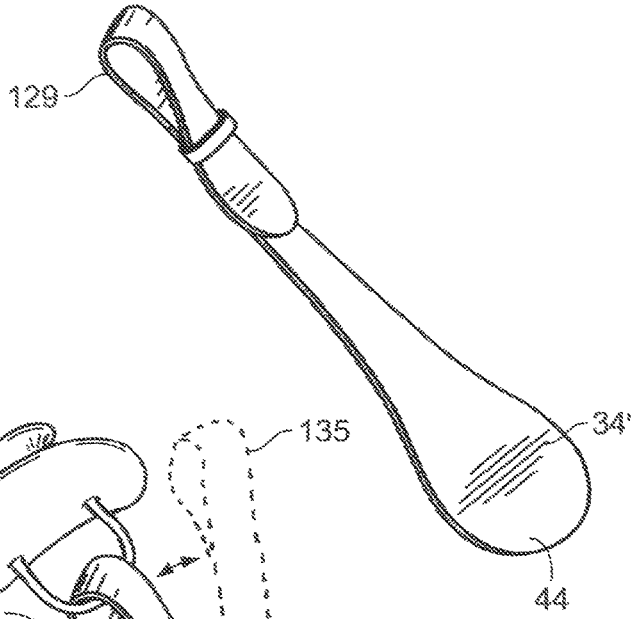
FIGS. 16A-16C illustrate an exemplary holding strap with an adjustable neck used with the present nook.
Figure 16B:
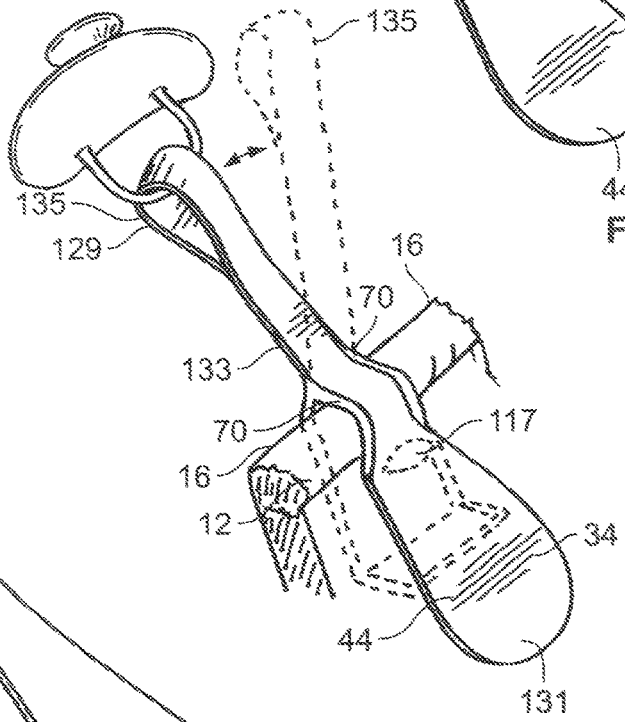
Figure 16C:
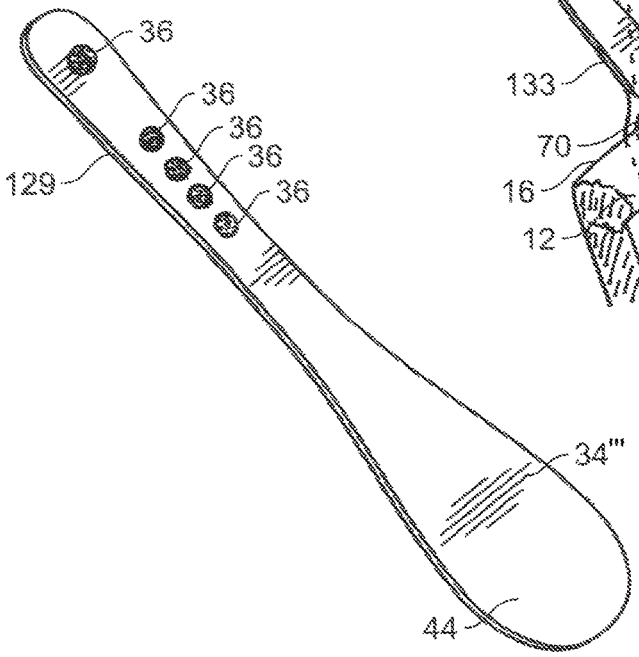

FIG. 16A shows the gripping strip 34' having a belt like loop and is the finishing attaching member as shown in FIG. 16C. FIG. 16B shows the gripping strip 34" having a flexible, adjustable body by pivoting about a mid-region 127 of the body. As with the auxiliary pouch member 58', 58", the gripping strip 34" may include the accommodating material region 117 near the upper region gripping strip. In FIG. 16B, as an example only, a pacifier is attached to an adjustable baby loop strap 129 for easy access to the baby. The baby loop strap 129 may include a partial steel or boning plastic member and the remainder is loosely flexible. It is preferred that the baby loop strap 129 has a gripping finger 131, an adjustable neck 133 and a pliable upper 135, such that the neck 133 can be selectively positioned by bending the upper 135. FIG. 16C shows the gripping strip 34'" having a plurality of adjustable fasteners or snaps 36.

Referring now to FIGS. 3A-3C, 17A-17C and 18A-18C, various types or embodiments of clamping members 106', 106" configured to releasably attach the sheet 28 to the tray 12 are illustrated. FIG. 3A illustrates that a turning clamp 125 is disposed in the lower flexible member 32 for securely attaching and fastening the nook 10 onto the tray 12. For example, the turning clamp 125 is integrated into the left and right attachment regions 38, 40 of the lower flexible member 32 such that when the lower flexible member is snapped dual locked or fastener is used into the periphery 16 of the tray 12, the turning clamp is fastened manually for secure attachment.

Figure 17A:
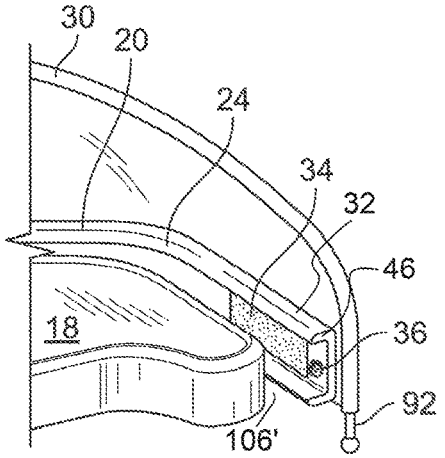
FIGS. 17A-17C illustrate exemplary methods and options for attaching the present nook to the tray.
Figure 17B:
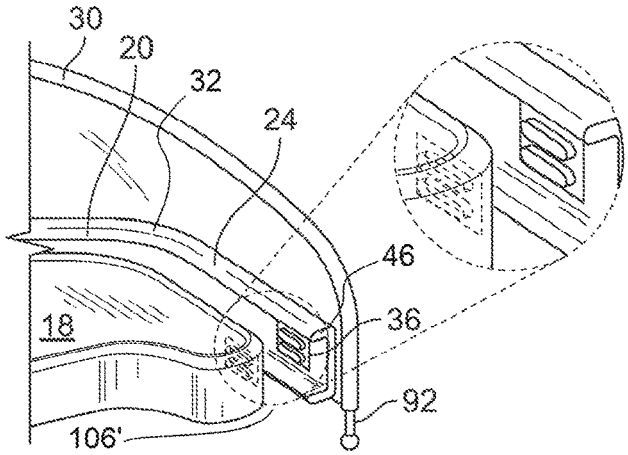
Figure 17C:
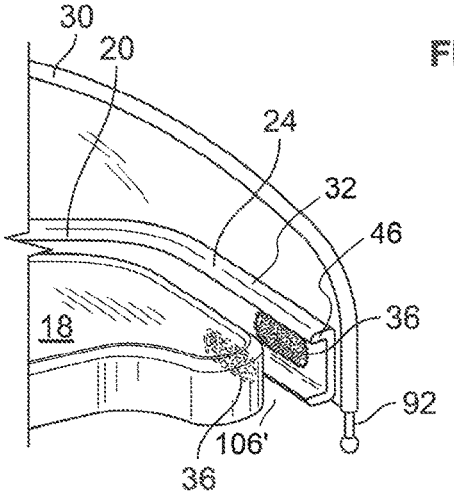

In another embodiment, a disengaging or safety lock 108 (FIG. 3B) is disposed in the lower flexible member 32 of the present nook 10. FIG. 17A shows the clamping member 106' having the gripping strip 34 and the fastener or snap 36. FIG. 17B shows the clamping member 106' having the fastener or snap 36 with a male and female dual lock system. FIG. 17C shows the clamping member 106' having the hook and loop type fastener. Other suitable attachment devices or methods are contemplated to suit the application. All of the above connecting components shown in FIGS. 17A-17C can be directly applied onto the tray 12 with adhesives, rivets, screws, or molded into the tray for a fixed attachment.

FIG. 18A shows the clamping member 106" which is separate and independent from the present nook 10. Unlike the clamping member 106' fixedly attached to the lower flexible member 32 of the present nook 10 and the tray 12, the clamping member 106" is removably attached to the tray 12 and sandwiched between the tray and the present nook 10 when assembled. When the clamping member 106" is attached to the tray 12, the present nook 10 can be attached to the clamping member 106" using the methods shown in FIGS. 17A-17C.

Figure 2D:
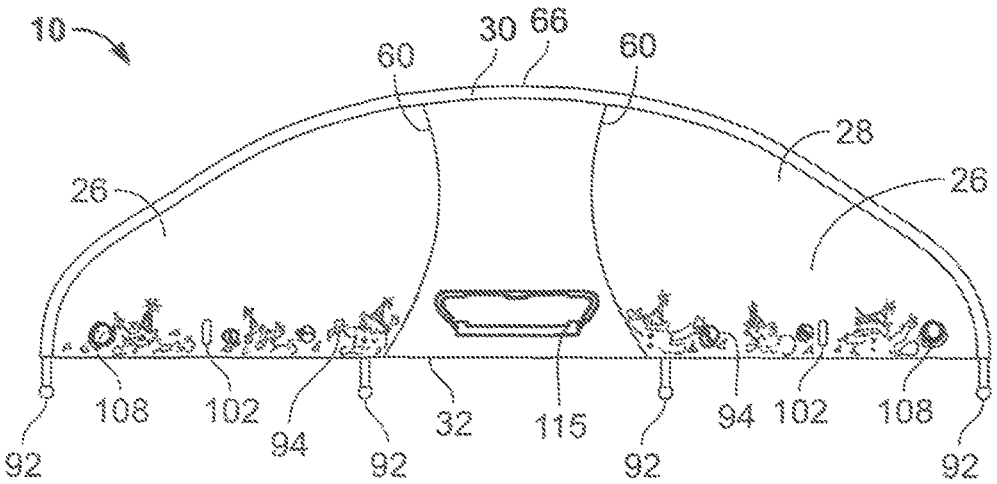
Figure 19A:
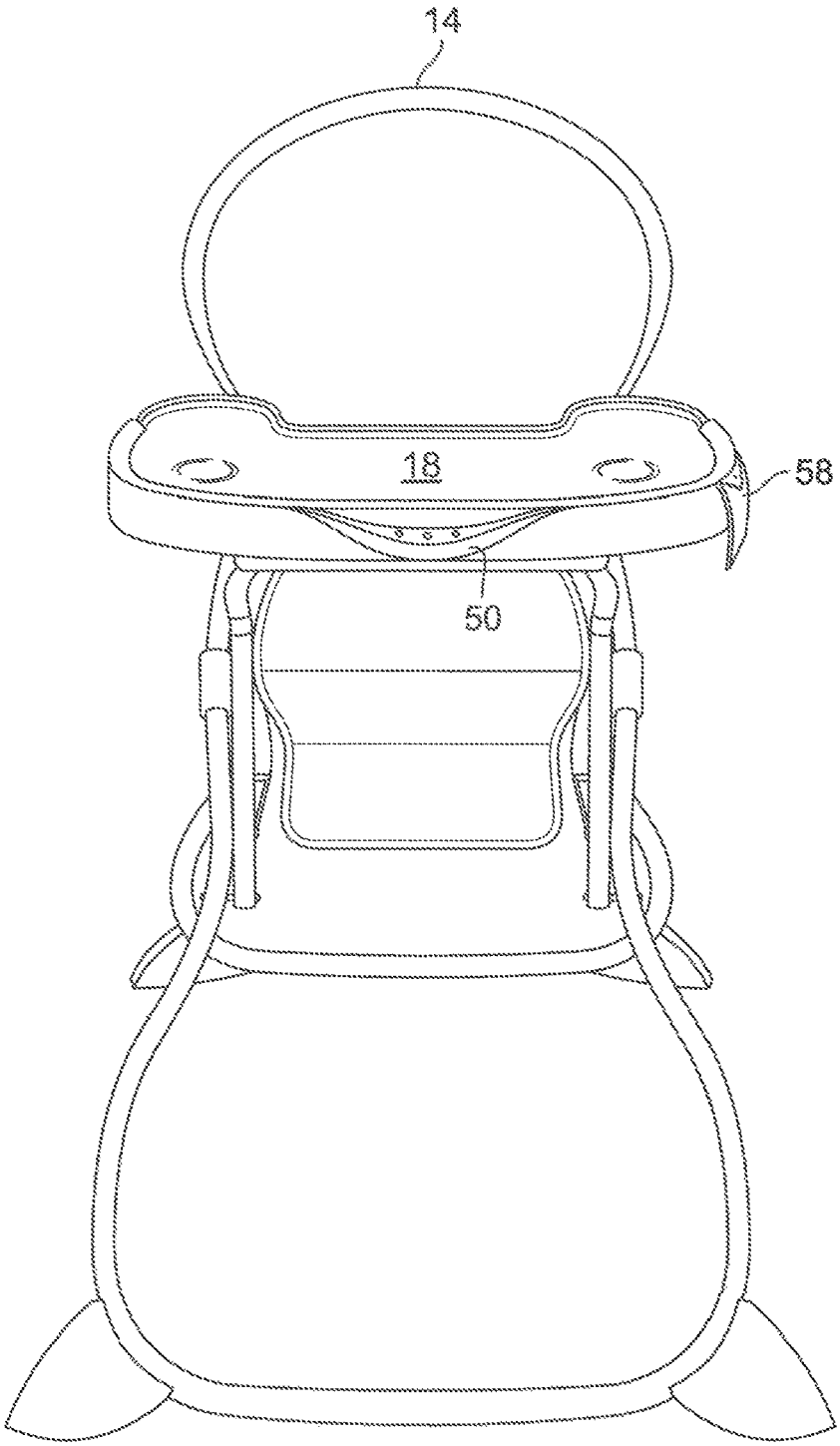
FIG. 19A illustrates a front view of the tray featuring the pouch member of FIG. 3A in a different position around the tray.
Figure 19B:
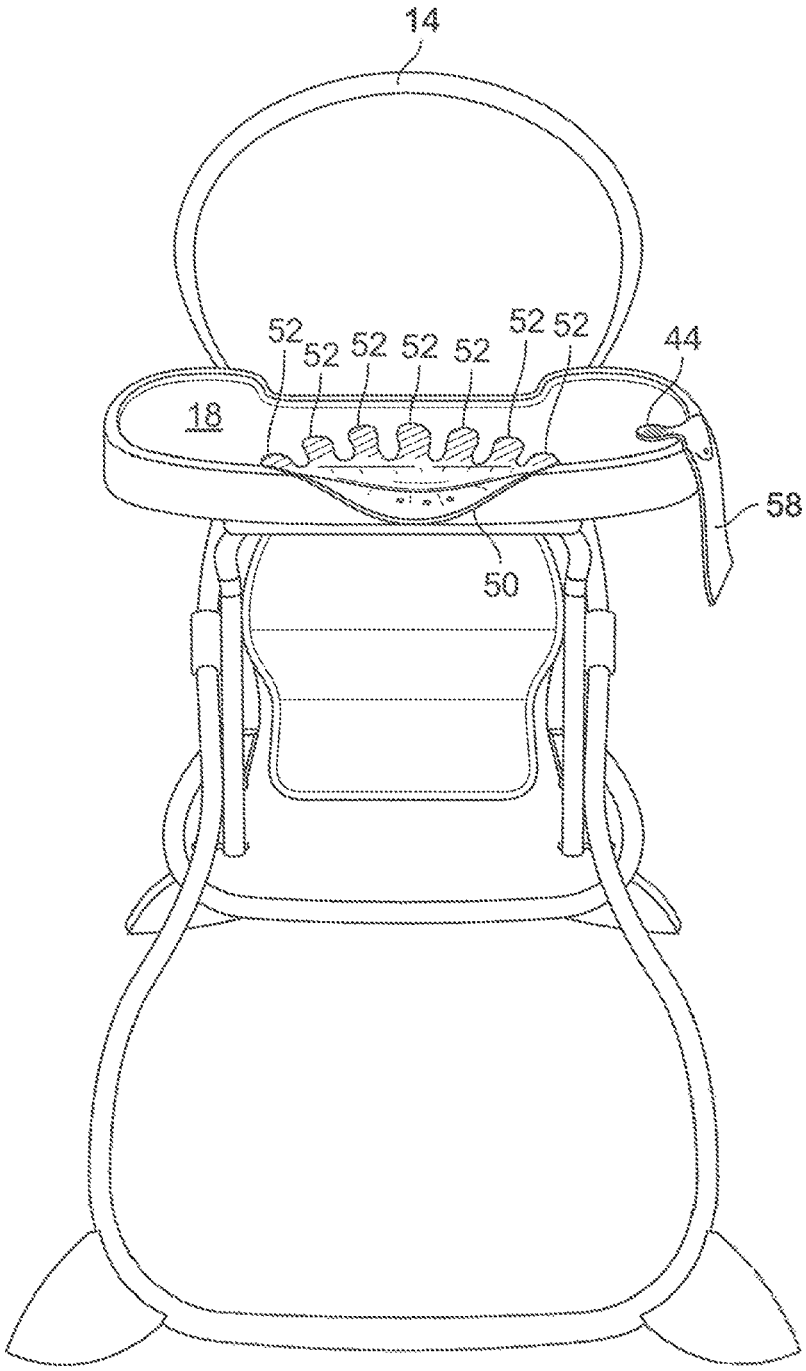
FIG. 19B illustrates a front view of the tray of FIG. 19A without the upper tray member.
Figure 20:
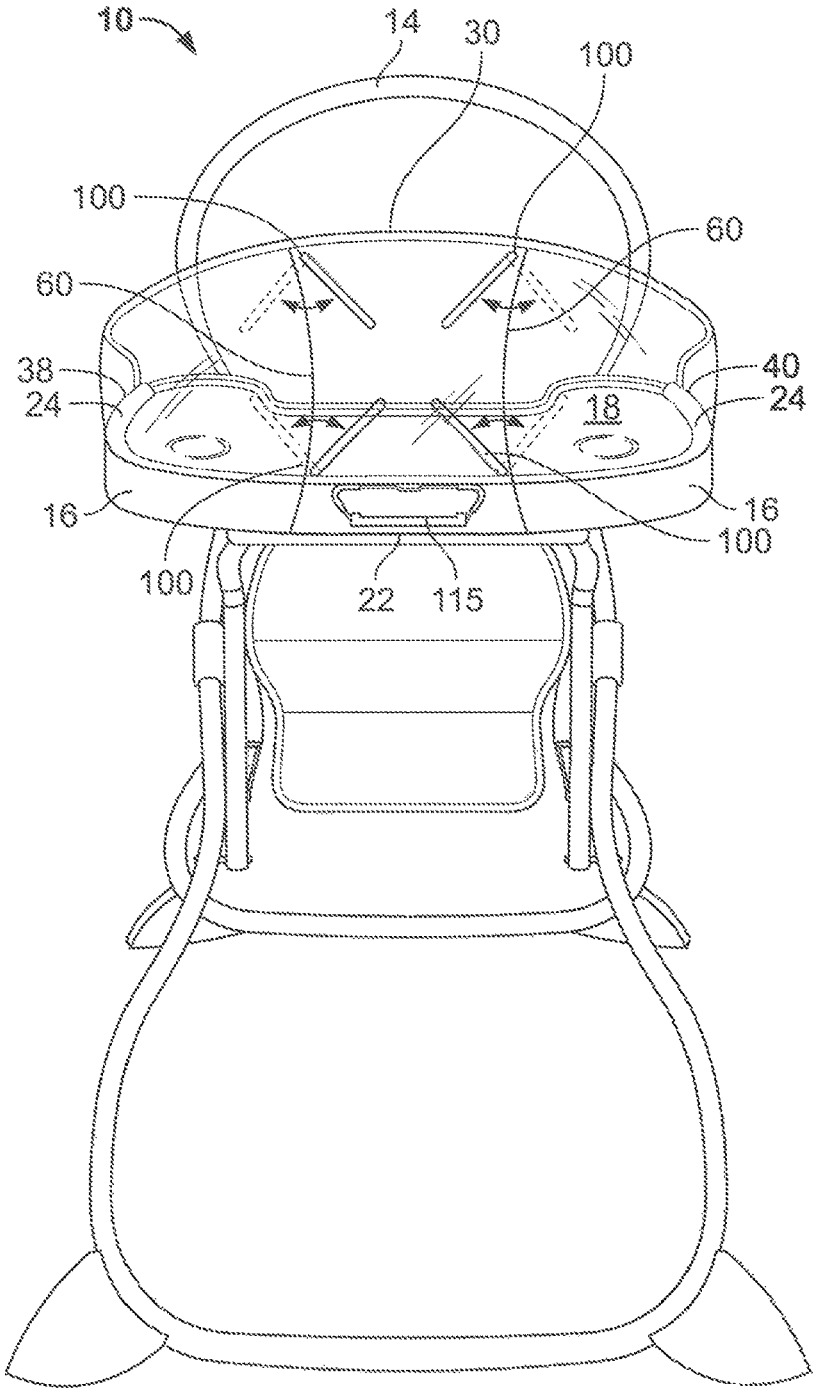
FIG. 20 illustrates a front view of the tray featuring a pocket sleeve, a plurality of swivel arms, and a lower clip used with the present nook.

FIG. 19A shows an exemplary positional use of the pouch member 50 and the auxiliary pouch member 58. FIG. 19B shows the pouch members 50, 58 without the upper tray member 54. FIG. 20 shows an exemplary spring-biased clip 115 disposed on the lower flexible member 32 of the present nook for holding or securing an electronic device. Other suitable locations of the clip 115, the hooks 92 and 102 (FIGS. 2C, 2D), or the like are contemplated to suit different applications.

Figure 21B:
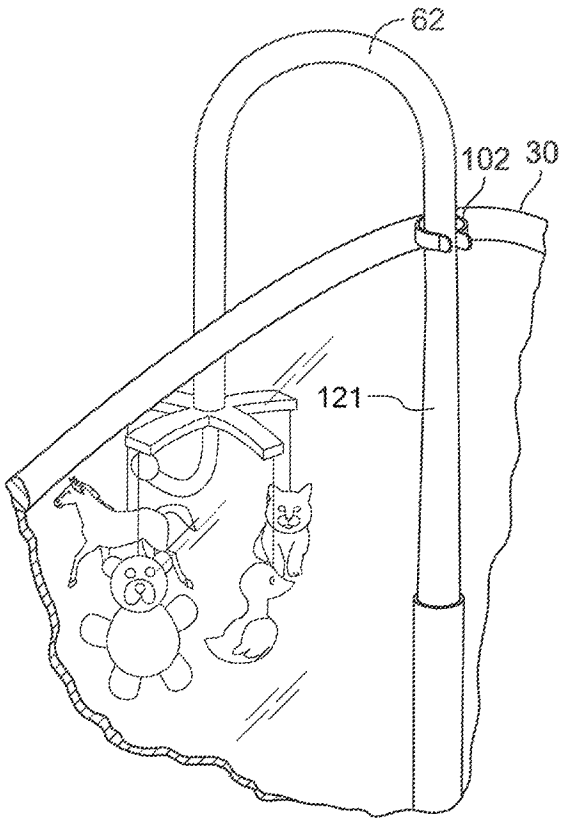
FIGS. 21A-21B illustrate an exemplary activity item mobile used with the present nook.
Figure 21A:
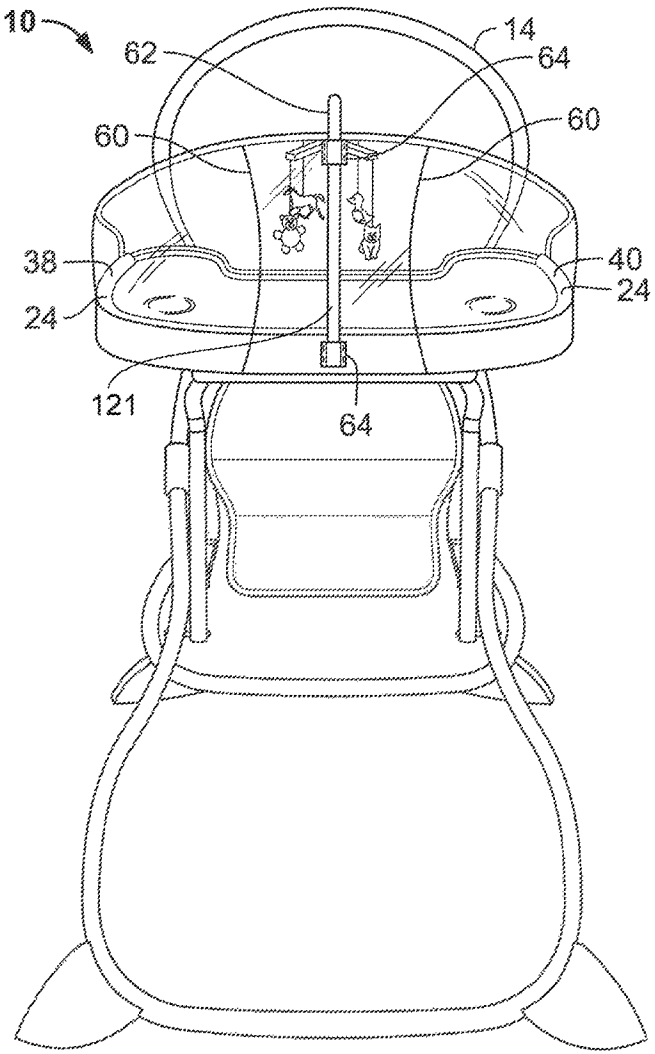
Figure 22A:
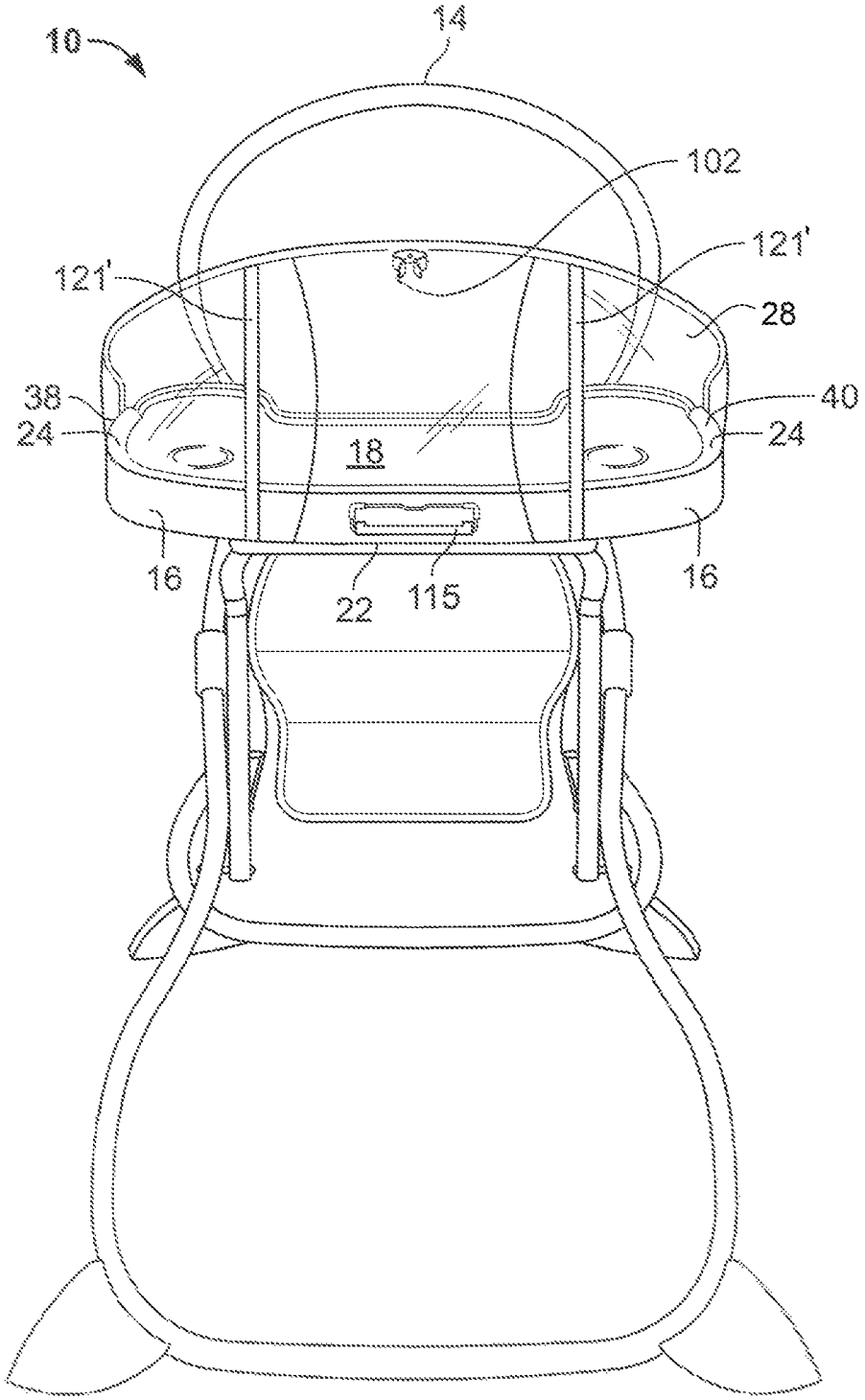
FIGS. 22A-22B illustrate exemplary vertical supports used with the present nook.
Figure 22B:
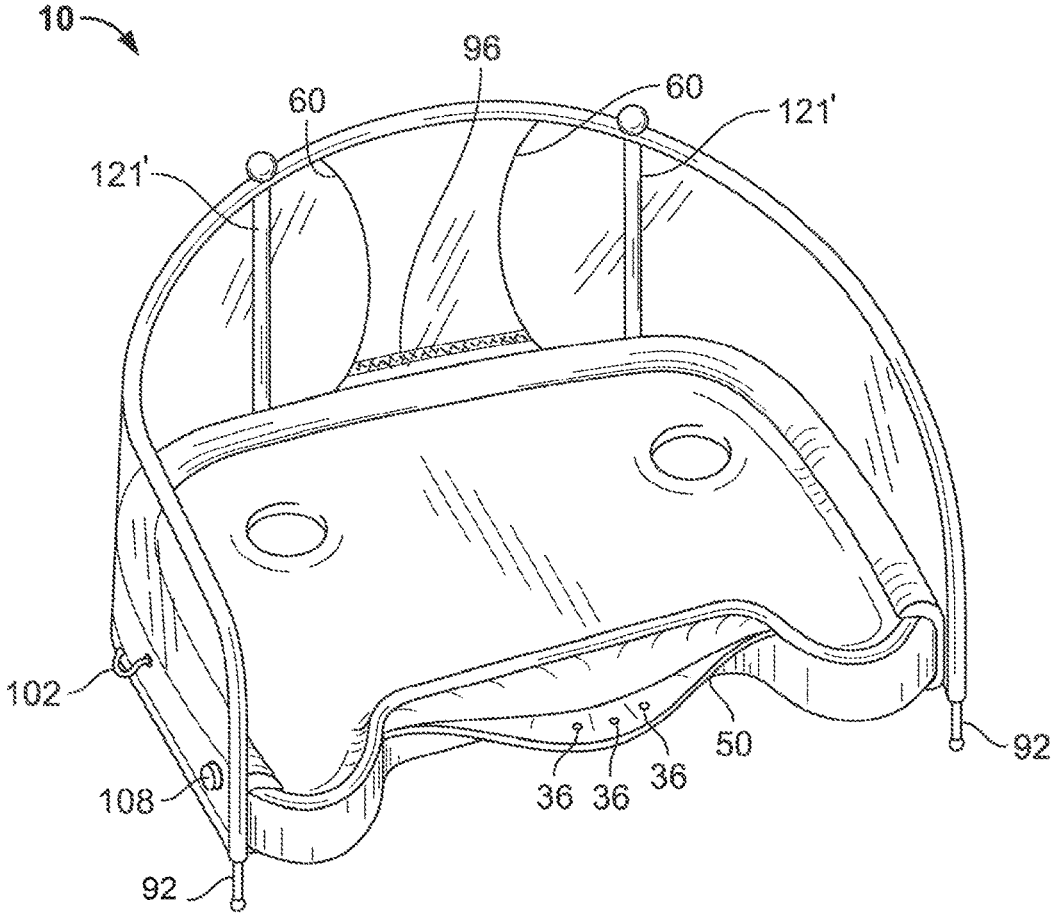

Referring now to FIGS. 21A-21B and 22A-22B, it is contemplated that at least one vertical support 121 is provided to securely hold the sheet 28 of the present nook 10 in an upright position. FIGS. 21A and 21B show the vertical support 121 configured for attaching a hanging display toy at one end of the vertical support. FIGS. 22A and 22B show a dual vertical support 121' configured for supporting the semicircular or curved edged sheet 28 of the present nook 10.

While a particular embodiment of the present nook has been described herein, it will be appreciated by those skilled in the art that changes and modifications may be made thereto without departing from the present disclosure in its broader aspects and as set forth in the following claims.

What is claimed is:

1. A nook for protecting a surrounding environment from contamination and being removably attached to an outer circumferential periphery of an open chair tray for at least partially encompassing an upper surface of the tray, the nook comprising:

an upper overhanging lip and a lower overhanging lip attached to the nook configured for overlapping corresponding upper and lower surfaces of the outer circumferential periphery of the tray, said upper and lower lips being part of a lower flexible member;

a transparent flexible sheet being supported by said flexible member;

a flexible inner liner member is attached along a vertical surface between said upper and lower lips for enhancing gripping action of said lips upon the periphery of the tray;

a sleeve member disposed on the flexible sheet and configured for placing an object within the pocket member;

the nook is formed by bending the sheet into a generally "U"-shaped structure corresponding to the outer circumferential periphery of the tray; and the nook has at least one fastener on an interior surface of said lower flexible member for releasably engaging the circumferential periphery of the tray.

2. The nook of claim 1, wherein the overhanging lips are integrally formed as a continuous single unit extending from a bottom peripheral portion of the tray.

3. The nook of claim 1, wherein a children themed decoration is disposed on said flexible sheet.

4. The nook of claim 1, wherein the at least one fastener includes at least one of: a hook and loop system, a dual lock system, a male-to-female system, and a mating surfaced snap.

5. The nook of claim 1, wherein a securing member is disposed near an outer peripheral edge of the pocket member for securing the object associated with the nook.

6. The nook of claim 1, wherein the nook has an upper flexible arch member.

7. The nook of claim 6, wherein the lower flexible member includes a disengaging or safety lock.

8. The nook of claim 6, wherein the upper arch member has a rolled hem or rounded channel extending along an upper edge of the sheet.

9. The nook of claim 8, wherein a flexible, reinforcing boning is inserted in the rolled hem or rounded channel, and extends along the length of the hem or channel.

10. The nook of claim 1, wherein the nook includes a baby loop strap with a gripping flap having an adjustable neck and a pliable upper.

11. The nook of claim 1, wherein the nook includes an upwardly projecting, vertically-oriented pocket member configured for storing the object in the vertically-oriented pocket member.

12. The nook of claim 1, wherein the nook includes a clamping member configured to releasably attach the lower flexible member to the tray.

13. The nook of claim 1, wherein the nook includes at least one vertical support for securely holding the sheet in an upright position.

14. The nook of claim 1, further including at least one flexible gripping flap extending from said lower flexible member.

15. A nook for protecting a surrounding environment from contamination and being removably attached to an outer circumferential periphery of an open chair tray for at least partially encompassing an upper surface of the tray, the nook comprising:

an upper overhanging lip and a lower overhanging lip attached to the nook configured for overlapping corresponding upper and lower surfaces of the outer circumferential periphery of the tray, said upper and lower lips being part of a lower flexible member;

a transparent flexible sheet being supported by said flexible member;

a flexible inner liner member is attached along a vertical surface between said upper and lower lips for enhancing gripping action of said lips upon the periphery of the tray;

a sleeve member disposed on the flexible sheet and configured for placing an object within the pocket member;

the nook is formed by bending the sheet into a generally "U"-shaped structure corresponding to the outer circumferential periphery of the tray; and the nook includes a removably attachable pouch member having at least one gripping flap, and a supplemental upper tray member fitting over the open chair tray and sandwiching said at least one gripping flap between said upper tray member and the open tray for holding said pouch member in position.

16. The nook of claim 15, wherein the pouch member includes a partial accommodating material region for providing recoverable stretch properties.

17. A nook for protecting a surrounding environment from contamination and being removably attached to an outer circumferential periphery of an open chair tray for at least partially encompassing an upper surface of the tray, the nook comprising:

an upper overhanging lip and a lower overhanging lip attached to the nook configured for overlapping corresponding upper and lower surfaces of the outer circumferential periphery of the tray, said upper and lower lips being part of a lower flexible member;

a flexible sheet;

an upper flexible arch member and said lower flexible member for supporting the sheet;

a removably attachable pouch member having at least one flexible gripping flap, and a supplemental upper tray member fitting over the open chair tray and sandwiching said at least one flexible gripping flap between said upper tray and the open tray for holding said pouch member in position; and wherein the nook is formed by bending the sheet into a generally "U"-shaped structure corresponding to the outer circumferential periphery of the tray.

* * * * *